US011220380B2

(12) United States Patent
Kachian et al.

(10) Patent No.: US 11,220,380 B2
(45) Date of Patent: Jan. 11, 2022

(54) CHILD-RESISTANT CONTAINERS AND PACKAGING

(71) Applicant: More Agency, Inc., Van Nuys, CA (US)

(72) Inventors: Ruben Kachian, Van Nuys, CA (US); Mike Toroyan, Granada Hills, CA (US)

(73) Assignee: Raymond Christopher Enterprises LLC, Livonia, MI (US)

( * ) Notice: Subject to any disclaimer, the term of this patent is extended or adjusted under 35 U.S.C. 154(b) by 160 days.

(21) Appl. No.: 16/528,554

(22) Filed: Jul. 31, 2019

(65) Prior Publication Data

US 2020/0039707 A1 Feb. 6, 2020

Related U.S. Application Data

(60) Provisional application No. 62/712,874, filed on Jul. 31, 2018.

(51) Int. Cl.

| | |
|---|---|
| ***B65D 43/16*** | (2006.01) |
| ***B65D 50/00*** | (2006.01) |
| ***B65D 55/02*** | (2006.01) |
| ***B65D 5/38*** | (2006.01) |
| ***B65D 25/14*** | (2006.01) |

(52) U.S. Cl.

CPC ..... *B65D 50/00* (2013.01); *B65D 5/38* (2013.01); *B65D 25/14* (2013.01); *B65D 43/163* (2013.01); *B65D 55/02* (2013.01)

(58) Field of Classification Search

CPC ..... B65D 43/22; B65D 43/16; B65D 43/163; B65D 55/02; B65D 25/14; B65D 5/38; B65D 50/00

USPC ..... 206/1.5, 531, 532; 132/293

See application file for complete search history.

(56) References Cited

U.S. PATENT DOCUMENTS

| | | | | |
|---|---|---|---|---|
| 5,275,291 | A | 1/1994 | Sledge | |
| 2002/0185404 | A1 | 12/2002 | Donegan | |
| 2007/0284277 | A1 | 12/2007 | Gnepper | |
| 2008/0215440 | A1* | 9/2008 | Peterson | G06Q 30/0225 705/14.26 |
| 2009/0236357 | A1 | 9/2009 | Graid | |
| 2013/0248531 | A1 | 9/2013 | Lane | |
| 2014/0014538 | A1 | 1/2014 | Dawson | |
| 2015/0021326 | A1 | 1/2015 | Giraud | |
| 2016/0122117 | A1* | 5/2016 | Moore | B65D 81/268 206/204 |

(Continued)

*Primary Examiner* — King M Chu

(74) *Attorney, Agent, or Firm* — Lowry Blixseth APC; Scott M. Lowry

(57) ABSTRACT

The child-resistant container includes a receptacle having an inner cavity, a lid that selectively couples with the receptacle to enclose the inner cavity when in a locked position, and a lock movable between the locked position securing the lid to the receptacle to substantially prevent access to the inner cavity and an unlocked position permitting the lid to move relative to the receptacle to expose access to the inner cavity. The receptacle and lid combination may include a lid that pivots relative to a container about a hinge and locks thereto by locking catches in the container sidewalls; or may include an outer housing enclosing an inner storage container in slide-in relation, wherein a pair of safety tabs extend from the inner storage container and through the outer housing into a respective pair of locking channels formed therein.

25 Claims, 22 Drawing Sheets

(56) References Cited

U.S. PATENT DOCUMENTS

| | | | | |
|---|---|---|---|---|
| 2016/0241107 | A1 | 9/2016 | Everett | |
| 2018/0037380 | A1* | 2/2018 | Giraud | B65D 50/04 |

* cited by examiner

CHILD-RESISTANT CONTAINERS AND PACKAGING

BACKGROUND OF THE INVENTION

The present invention generally relates to child-resistant containers and/or packaging. More specifically, the present invention relates to child-resistant containers and/or packaging that include a safety lock or latch or a pair of safety tabs requiring a desired minimum level of dexterity to disengage before the container or package may be opened to access contents therein.

In 1970, Congress enacted the Poison Prevention Packaging Act ("PPPA") in response to a relatively high number of children ingesting hazardous household products (e.g., ranging from household cleaning products to prescription medications). According to the U.S. Consumer Products Safety Commission ("CPSC") at the time, poisonings from household products were one of the leading causes of injuries for children under five. Thus, the PPPA was designed to establish a new set of regulations that govern the safety of packaging products that could be harmful to young children if ingested. The basic criteria for PPPA compliant products was that the containers or packaging necessarily needed to increase the difficulty associated with opening the container or package to access the contents therein. Accordingly, this would allow adults—having a certain minimum level of dexterity greater than that of younger children—to open the containers to access product therein, while effectively frustrating a younger child's ability to comparatively do the same.

In time, products created in response to the PPPA have become known as childproof or child-resistant containers and/or packaging due to design features that make it difficult (if not impossible) for children under a certain age to open the container or package to access the contents therein. Child-resistant containers and packaging have thus played an important role in substantially inhibiting children from accessing potentially dangerous products, such as harmful chemicals, medical prescriptions, and other substances that may be particularly harmful if ingested by a child. In fact, such child-resistant container and packaging designs have been so effective in the years since 1970 that oral prescription medicine-related deaths have dropped in the United States from approximately 1.4 deaths per year per million children under five, to a number so low that the CPSC has stopped tracking the statistic.

Some of the most well known child-resistant container designs are those associated with prescription medication bottles having a plastic (and difficult to remove) screw cap feature. For example, such prescription medication bottles come with a cap having a collar that secures over an uppermost portion or rim of the bottle container and closes in secure fashion therewith. The collar typically includes a pair of spring-based push tabs that include vertical extensions for engaging interlocking teeth on the innermost surface of a closure skirt when the cap is fully assembled onto the bottle. To remove the cap, each push tab, which are typically positioned opposite one another, are manually depressed prior to applying unscrewing torque to the cap. Such a downward force disengages the push tab extensions from the interlocking teeth on the cap. Accordingly, once disengaged, the cap can be turned from a locked configuration preventing access to the contents inside the container to an unlocked position permitting cap removal. Such packages with secure caps were considered highly improved child-resistance packaging without significantly impeding access by adults. Still, users necessarily need to use both hands to overcome the child resistant feature to unscrew the closure cap.

While deployment of the abovementioned child-resistant container and cap combination has been effective for use with traditional prescription medications (typically sold in pill or capsule form), in recent years, new issues have arisen as a result of medical products being disseminated in other configurations, such as consumables (e.g., gummies, chocolates, candies, and other like food products). Such medications have become especially popular in the medical marijuana industry where hemp-based therapeutic products (e.g., including CBD) are more commonly sold as food-grade products, in view of continued legalization at the state level over the past 5-10 years. Initially, there were little to no container or packaging requirements. Although, in recent years, states are starting to require that both medical and recreational marijuana products be packaged in child-resistant or childproof packaging at least at the point of purchase. This has been accomplished, e.g., by requiring that such medical marijuana products be packaged in a bag incorporating childproof or child-resistant features. Specifically, e.g., edible products such as brownies, cookies, gummies, chocolates, etc. must be sold by dispensaries in hard-to-open packaging (e.g., pouches) difficult for a child to access. Although, the problem with these so-called "exit" bags is that, once home, studies have shown that buyers remove the products (e.g., vaporizers, edibles, flowers, etc.) from the packaging for storage in open or otherwise easily accessible containers that children can access. Thus, children may be exposed to medical marijuana products around the house in what largely amounts to unsafe storage containers and packaging. Current child proof or resistant packaging on the market does not meet the needs for securely storing product or otherwise making it inaccessible for storing medical products or the like post-purchase.

There exists, therefore, a significant need for a child-resistant or childproof container or package for home storage of medical products that substantially prevents or frustrates child access while also allowing adults to access the contents therein. Specifically, such child-resistant containers or packaging should include a safety lock or latch or a pair of safety tabs requiring a desired minimum level of dexterity to disengage before the container or package may be opened to access contents therein. The present invention fulfills these needs and provides further related advantages.

SUMMARY OF THE INVENTION

In one embodiment, a child-resistant container as disclosed herein may include a receptacle having an inner cavity, a lid that selectively couples with the receptacle in pivoting relation about a hinge to enclose the inner cavity when in a locked position, and a lock movable between the locked position securing the lid to the receptacle to substantially prevent access to the inner cavity and an unlocked position permitting the lid to move relative to the receptacle to expose access to the inner cavity. The child-resistant container may be made from a metal material selected from the group consisting of steel, aluminum, or a metal alloy. Alternatively, the child-resistant container may be made from a paper-based material, such as cardboard or the like. In some embodiments, a food-grade protective sheath may be disposed within an inner surface of the inner cavity and/or within an inner surface of the lid and may be selectively removable and/or replaceable so as to reduce longer-term ownership costs associated with the child-resistant container. In embodiments wherein the lock is disposed within the inner cavity, the protective sheath may also include an indent having a size and shape to accommodate the lock thereunder.

One or more of the sidewalls of the receptacle may include an annular shoulder vertically extending upwardly from a base and transitioning at an inwardly projecting step to an interiorly located upper rim having a wall thickness relatively smaller than the annular shoulder. The lid may include a downwardly extending annular skirt that selectively lands in seated relation on the inwardly projecting step and adjacent the upper rim when the child-resistant container is in the locked position. When seated, the downwardly extending annular skirt may encompass the upper rim to substantially prevent side-to-side movement relative thereto, to help prevent access to the inner cavity. To this end, the lock may include at least one locking catch outwardly extending from the receptacle that may include a downwardly facing planar shoulder that engages an inwardly curved lip of the annular skirt when the lid is in the locked position. Here, the lock may also include at least one channel having a spring therein that normally biases the locking catch and an integrally formed release button in a forward position externally accessible from the receptacle, wherein depression of the release button causes simultaneous movement of the normally hidden release button out from engagement with the inwardly curved lip, to release the lid from engagement with the receptacle. The at least one locking catch may also include a rounded upper surface opposite the downwardly facing planar shoulder to facilitate reconnection of the inwardly curved lip over the locking catches when pivoting the lid from the unlocked position to the locked position.

In another aspect of these embodiments, the lid may include an outer housing having a size and shape for select slide-in reception of the receptacle. Here, the receptacle may include a pair of safety tabs outwardly extending therefrom and normally residing forwardly in a pair of respective locking channels formed in the lid when the child-resistant container is in the locked position. The locking channels may also be in slideable relation with a pair of respective rearly positioned and relatively larger release channels. In these embodiments, the lid may include a spring that biases the receptacle into a forward position within the lid to locate the safety tabs into the respective locking channels. When in this locked position, a front end of the receptacle may protrude out from within the lid. To this end, the lid may also include a notch exposing a relatively larger surface area of the receptacle for enhanced hand manipulation re pull-out removal. When aligned with the release channels in the lid from at least partial compression of the spring with the receptacle, the safety tabs may pivot between a normal vertical position extending out from within the lid and a folded position adjacent a sidewall of the receptacle and within an interior of the lid, thereby permitting slide-out removal of the receptacle from the lid.

In another embodiment, the child-resistant container as disclosed herein may be made from a metal material selected from the group consisting of steel, aluminum, or a metal alloy and include a receptacle having an inner cavity, a lid that selectively pivots relative to the receptacle about a hinge to enclose the inner cavity and substantially prevent access to the inner cavity when in a locked position, and a lock that includes a spring that normally biases a catch and an integrally formed release button into a forward position outwardly extending from the receptacle. The catch may include a shoulder normally hidden when engaged the lid when in the locked position. The release button may be inwardly depressible against the spring to simultaneously move the catch out from engagement with the lid to an unlocked position permitting the lid to move relative to the receptacle to expose access to the inner cavity. To this end, opening the lid relative to the receptacle may expose the normally hidden catch.

In another aspect of this embodiment, the lock may be disposed within the inner cavity and a food-grade protective sheath may be disposed over an inner surface of the inner cavity and include an indent having a size and shape to accommodate the lock thereunder. Moreover, at least one sidewall of the receptacle may include an annular shoulder vertically extending upwardly from a base and transitioning at an inwardly projecting step to an interiorly located upper rim having a wall thickness relatively smaller than the annular shoulder. Here, the inwardly projecting step may have a size and shape to receive a downwardly extending annular skirt of the lid in seated reception thereof when the child-resistant container is in the locked position. As such, the downwardly extending annular skirt may encompass the upper rim when in seated reception on the inwardly projecting step. In another aspect of this embodiment, the catch may include a rounded upper surface opposite a downwardly facing planar shoulder to facilitate locking and unlocking.

In another embodiment, the child-resistant container may include a receptacle having an inner cavity, a lid forming an outer housing having a size and shape for select slide-in reception of the receptacle to enclose the inner cavity when in a locked position, and a lock including a safety tab outwardly extending from the receptacle and normally residing forwardly in a locking channel formed in the lid when the child-resistant container is in the locked position, to substantially prevent access to the inner cavity. Here, a spring in the form of a foam pad located within the lid may bias the receptacle into a forward position within the lid to locate the safety tab into a locking channel. When in the locked position, a front end of the receptacle may protrude out from the lid and include a notch therein to expose a relatively larger surface area of the receptacle for enhanced hand manipulation.

The safety tab may be in slidable relation with the locking channel and a rearly positioned and relatively larger release channel. As such, the safety tab may be movable out from within the locking channel to an unlocked position permitting slide-out removal of the receptacle from the lid to expose access to the inner cavity. More specifically in this respect, when aligned with the release channel in the lid from at least partial compression of the spring with the receptacle, the safety tab may pivot between a normal vertical position extending out from within the lid and a folded position adjacent a sidewall of the receptacle and within an interior of the lid, thereby permitting slide-out removal of the receptacle from the lid.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the exemplary drawings for purposes of illustration, the present invention for a child-resistant container and/or package is generally illustrated with respect to one embodiment of a child-resistant tin 30 in FIGS. 1-12 and with respect to a second embodiment of a child-resistant box 32 in FIGS. 13-28. As disclosed in more detail herein, the child-resistant tin 30 and the child-resistant box 32 are particularly ideal for both dispensary compliance purposes at the point of sale and for safe home use as each provides a container for continued safe storage after purchase.

Figure 1:
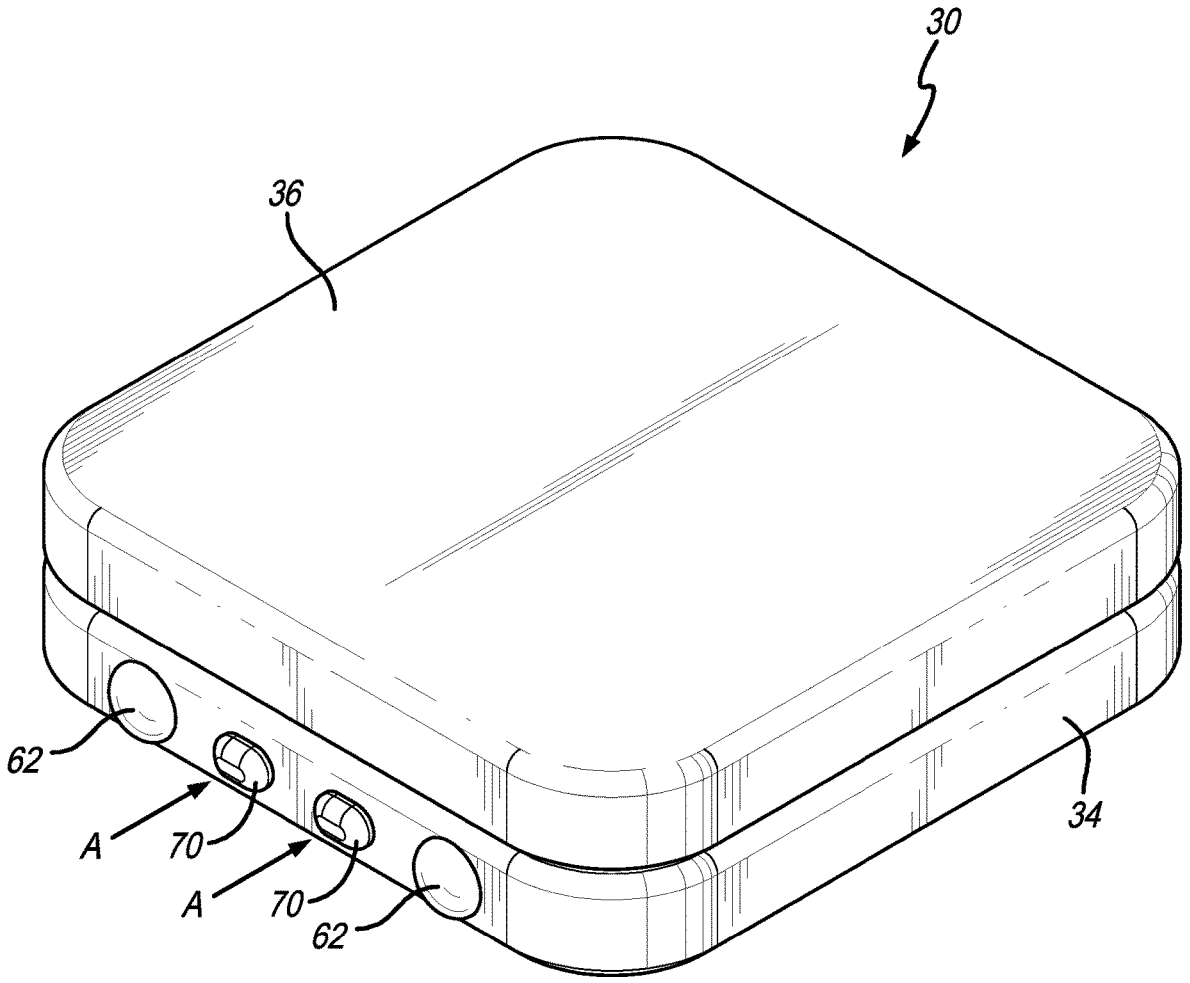
FIG. 1 is a perspective view illustrating a front, top and right sides of one embodiment of a child-resistant container as disclosed herein, in the form of a child-resistant tin.
Figure 2:
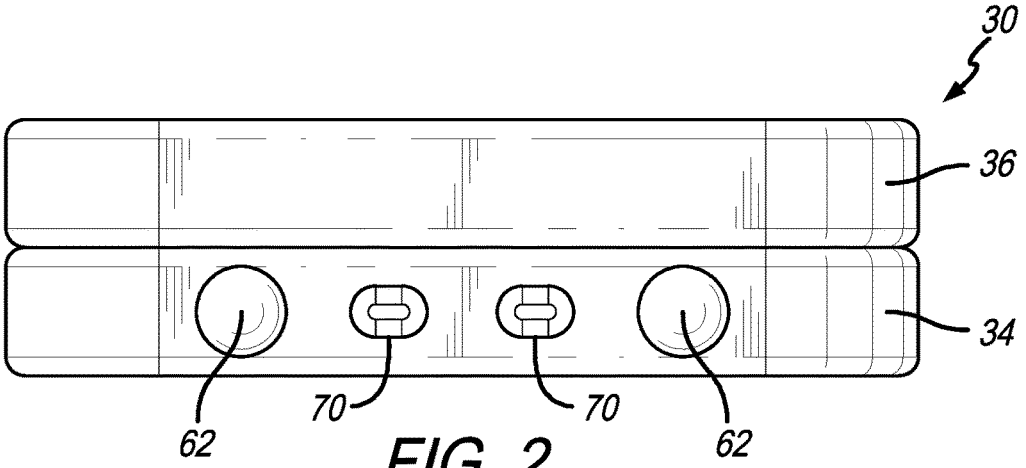
FIG. 2 is a front elevation view of the child-resistant tin of FIG. 1, more specifically illustrating a pair of sidewall mounted release buttons.
Figure 3:
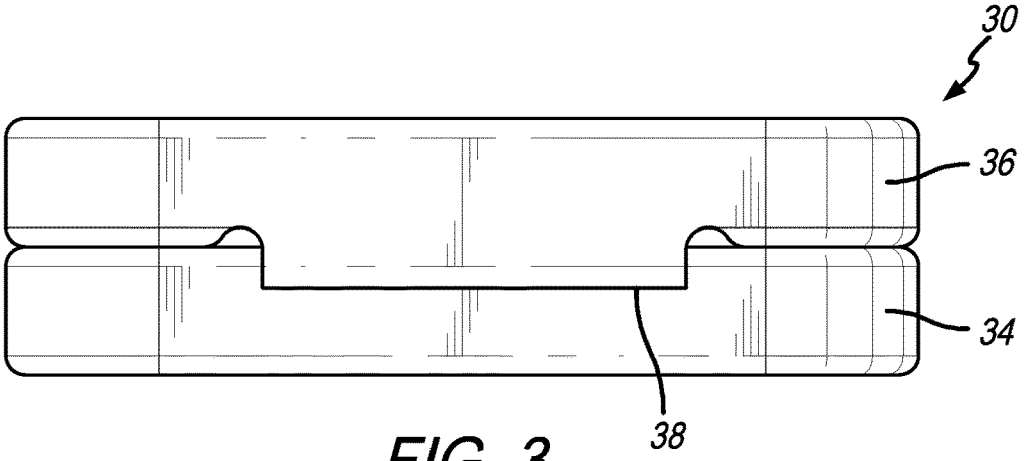
FIG. 3 is a rear elevation view of the child-resistant tin of FIGS. 1-2, more specifically illustrating an upper lid coupled to a lower storage container about a hinge.
Figure 4:
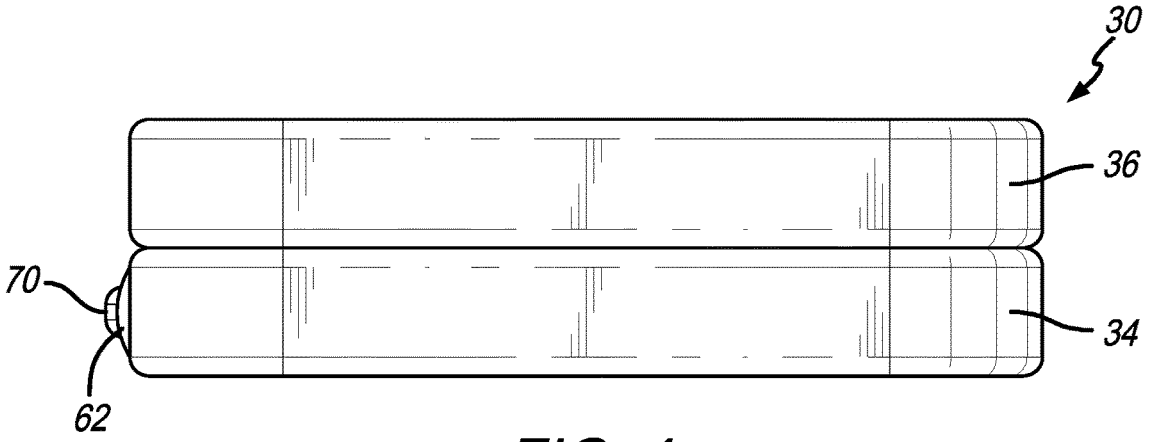
FIG. 4 is a left side elevation view of the child-resistant tin of FIGS. 1-3, illustrating the lid in a closed position.
Figure 5:
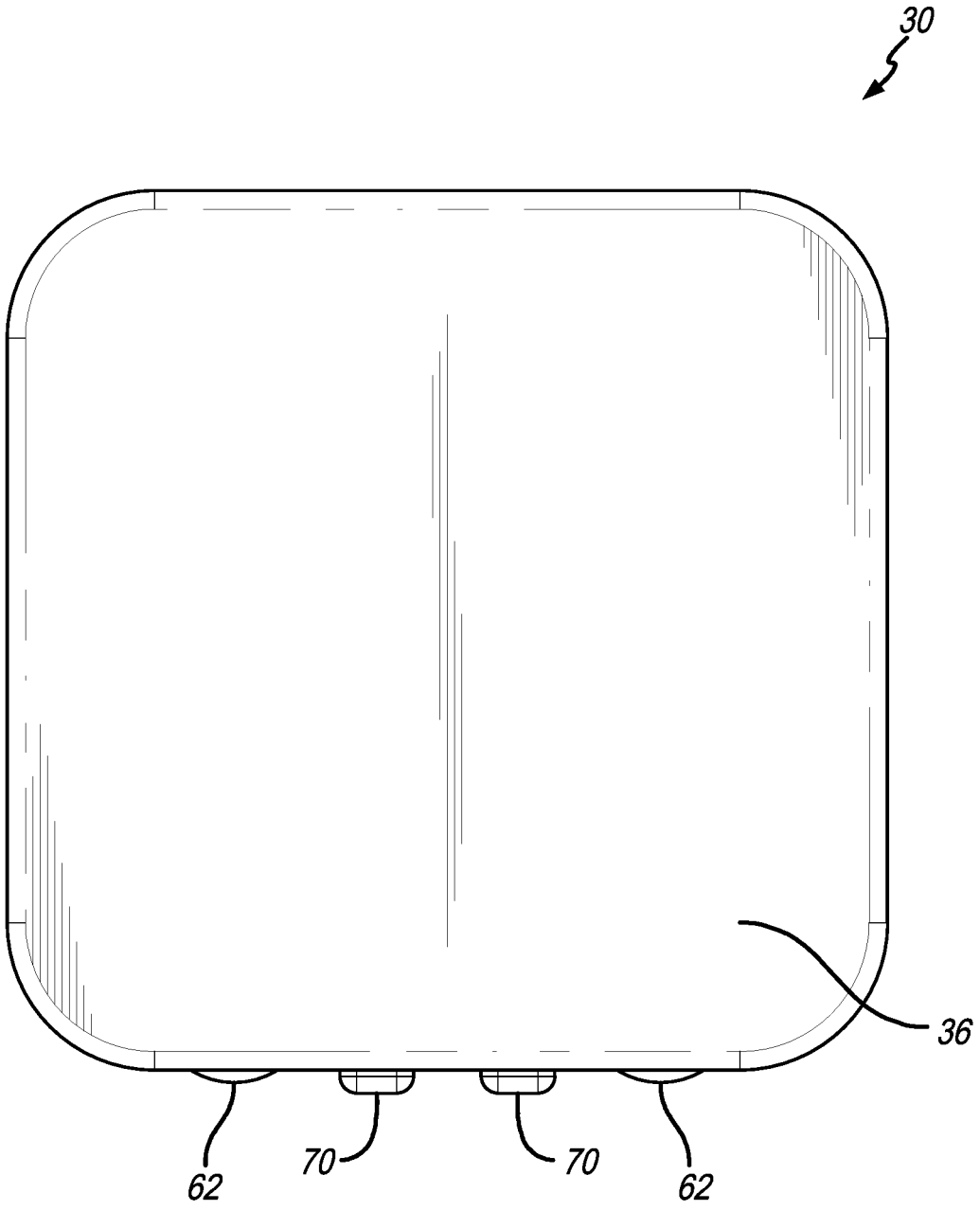
FIG. 5 is a top plan view of the child-resistant tin of FIGS. 1-4 with the lid in the close position.
Figure 6:
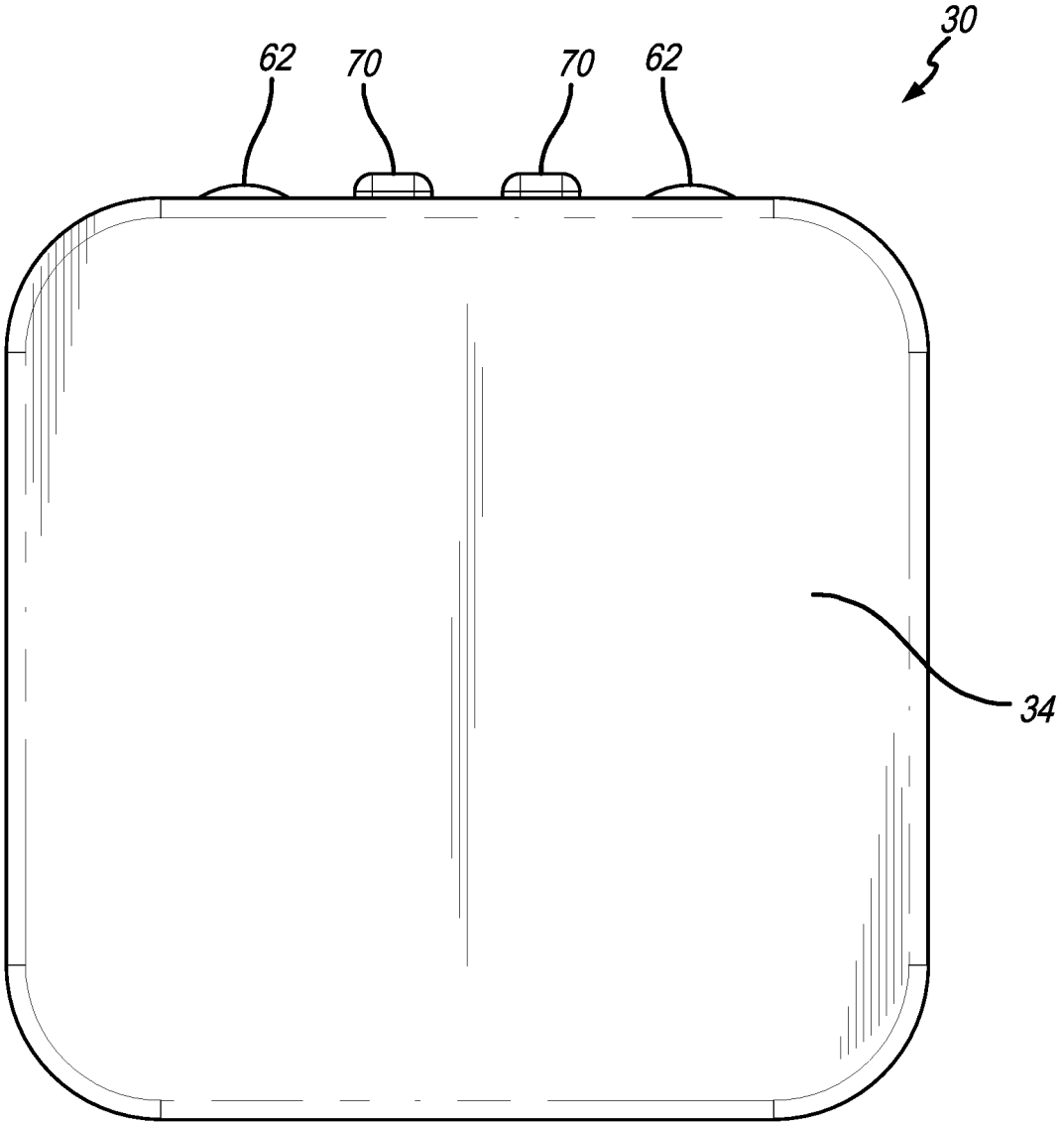
FIG. 6 is a bottom plan view of the child-resistant tin of FIGS. 1-5.

More specifically, the child-resistant tin 30 illustrated, e.g., in FIG. 1, includes a storage container 34 coupled to a lid 36 about a hinge 38. In general, as illustrated in FIGS. 1-9, the storage container 34 and the lid 36 are each generally of a rectangular shape, although a person of ordinary skill in the art would recognize that the shape may vary (e.g., square, circular, etc.). Each of the storage container 34 and the lid 36 are configured for interlocking engagement with one another to house contents therein, such as medical or medicinal products that include *Cannabis* or CBD, and include food-grade edibles (e.g., gummies, candies, chocolate, etc.). In this respect, the child resistant tin 30 may be made from a metal material such as steel, aluminum, or a related metal alloy material. Alternatively, the child-resistant tin 30 may be made from any food grade material. Additionally, or instead of, the child-resistant tin 30 may further include a food-grade protective sheath 39 (FIG. 7) that adheres to or otherwise substantially attaches to an interior surface area of the storage container 34 (FIG. 7) and/or the lid 36. A locking system 40 (best illustrated in FIGS. 9-12) effectively retains the lid 36 in a closed position (FIGS. 1-6) relative to the storage container 34 during non-use to ensure safety and general inaccessibility of the contents stored therein by children. In other words, when the child-resistant tin 30 is in the closed position, medical products that may be stored within the storage container 34 cannot be easily accessed absent operating the locking system 40. In one embodiment, the protective sheath 39 may include an indent 41 to accommodate and protect the operational components of the locking system 40 that may reside within the storage container 34, as disclosed in more detail below.

Figure 7:
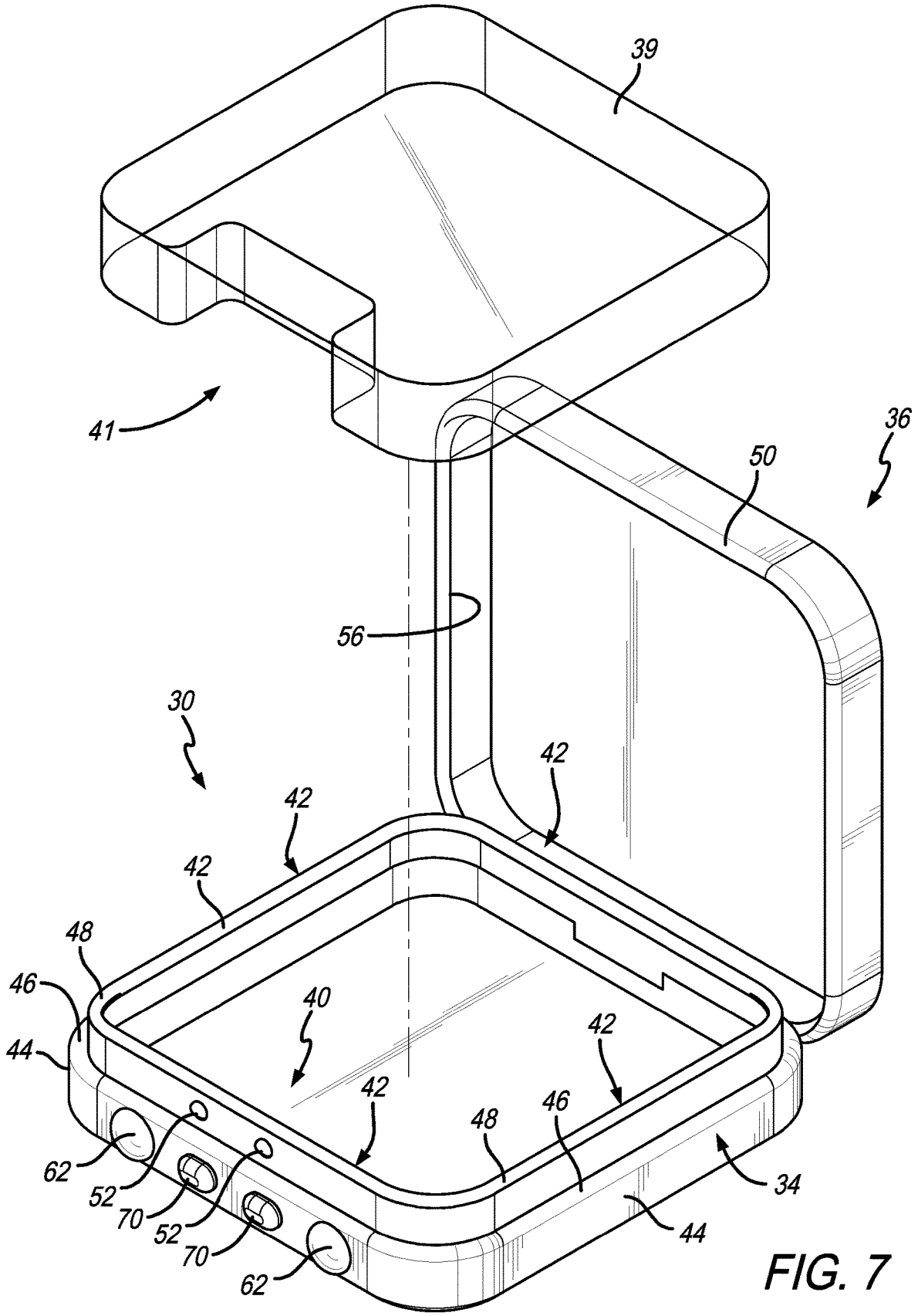
FIG. 7 is a partial exploded perspective view of the child-resistant tin similar to FIG. 1, further illustrating the lid in an open position exposing an inner storage cavity having an inner protective shield.
Figure 8:
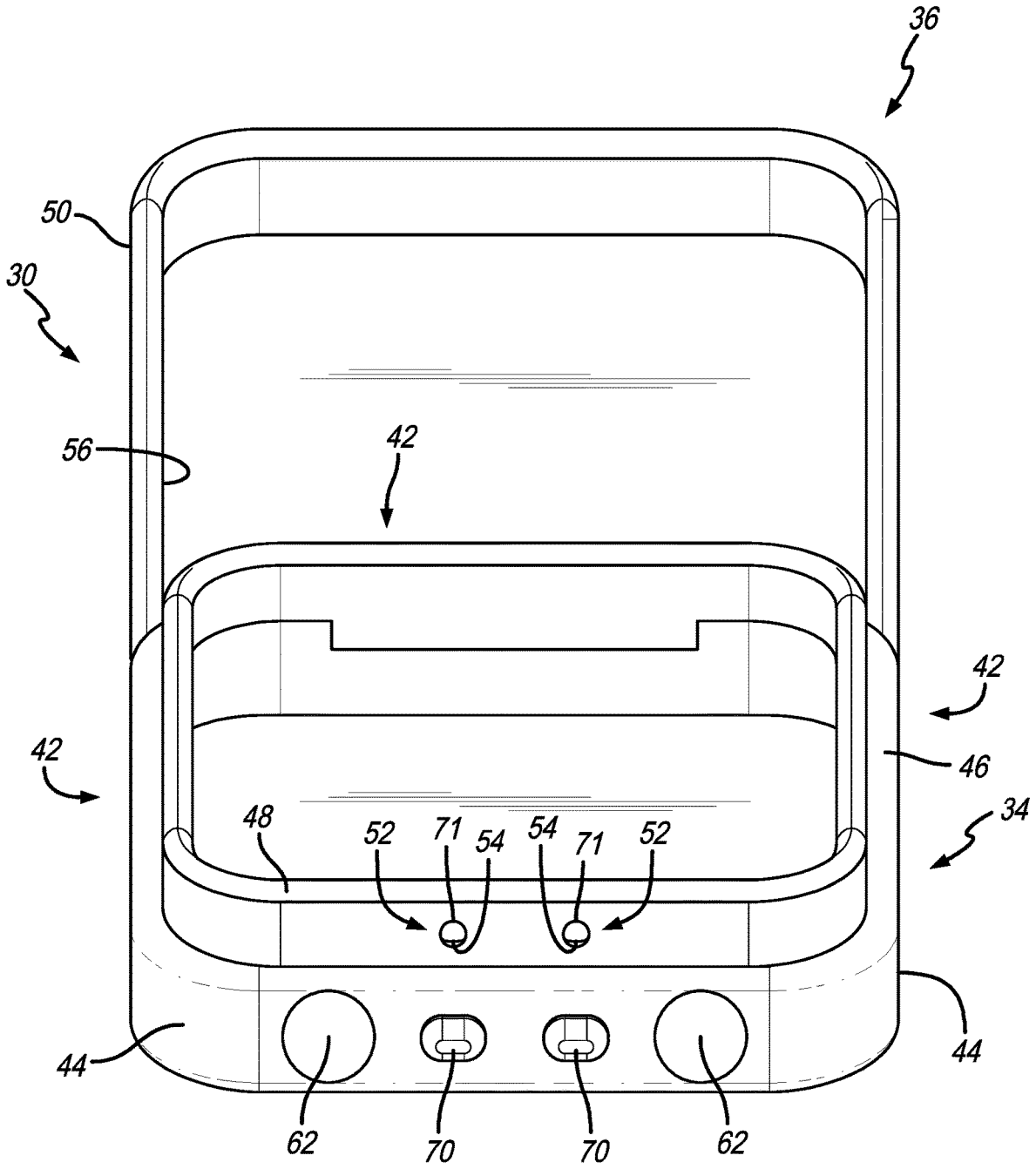
FIG. 8 is a front elevation view of the child-resistant tin similar to FIG. 2 with the lid in the option position, further illustrating a pair of locking catches normally hidden by the lid when in the closed position.
Figure 9:
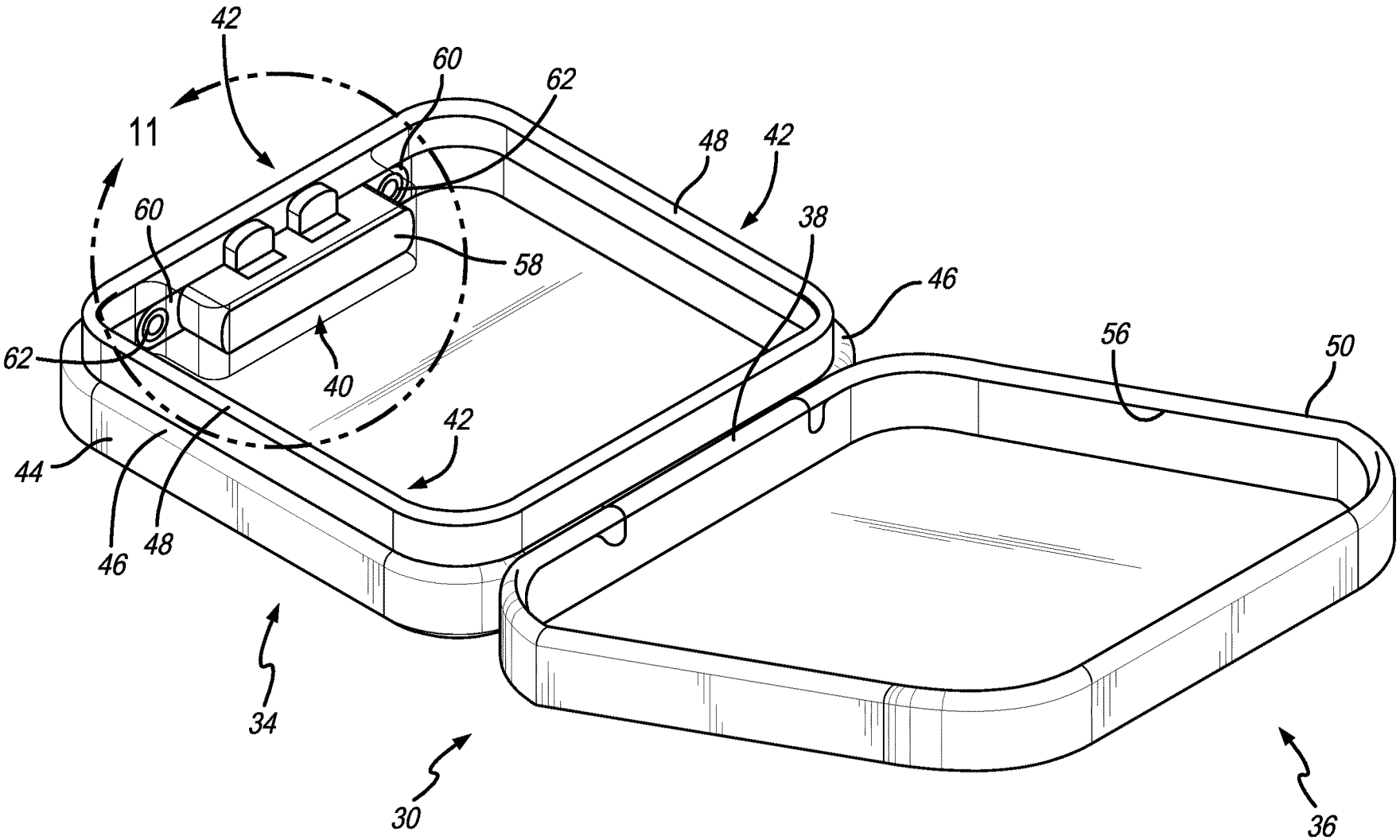
FIG. 9 is a perspective view illustrating a rear, top and right sides of the child-resistant tin with the lid in the open position, further illustrating a lock housing internally mounted within the inner storage cavity and carrying the release buttons and the pair of locking catches.

As best illustrated in FIGS. 7-9, the storage container 34 disclosed herein includes a series of interconnected side walls 42 that include a lower annular shoulder 44 vertically extending upwardly and that transitions at an inwardly projecting step 46 to an interiorly located upper rim 48 having a wall thickness relatively smaller than that of the lower annular shoulder 44. The formation of the annular shoulder 44, the step 46, and the upper rim 48 facilitates select landed and secured reception of the lid 36 onto the storage container 34. More specifically, the lid 36 includes a downwardly extending annular skirt 50 having a reciprocal size and shape of the void formed by the reduced wall thickness of the upper rim 48 relative to the annular shoulder 44 at the step 46. This allows the annular skirt 50 to land on the step 46 in adjacent relation to the upper rim 48 to prevent side-to-side movement of the lid 36 relative to the storage container 34 when in the closed position illustrated in FIGS. 1-6. Accordingly, when in this position, the annular skirt 50 generally encompasses the upper rim 48 to lock the contents (e.g., food products such as medicated gummies) inside. Locking engagement may be accomplished, e.g., by locking the lid 36 relative to the storage container 34 by way of a pair of locking catches 52 having a respective set of downwardly facing planar shoulders 54 designed to catch or otherwise sufficiently engage or retain an inwardly curved lip 56 of the annular skirt 50.

Figure 10:
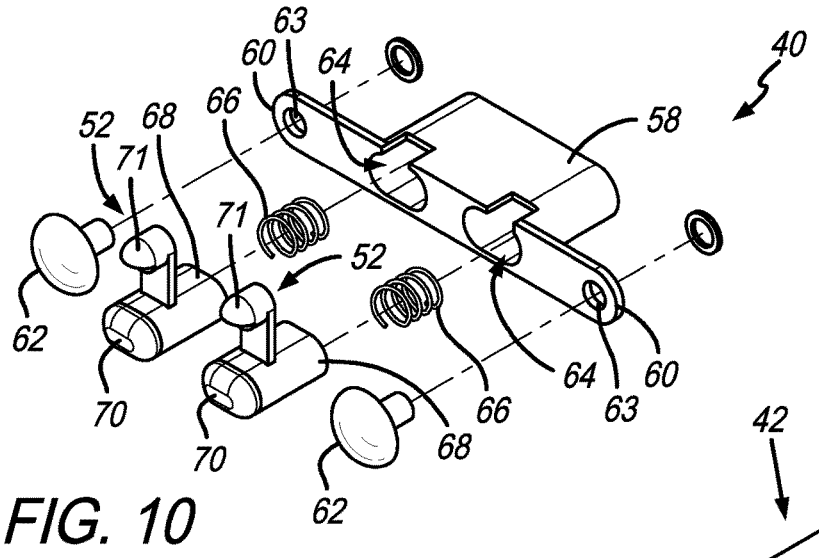
FIG. 10 is an exploded perspective view more specifically illustrating the locking system.
Figure 11:
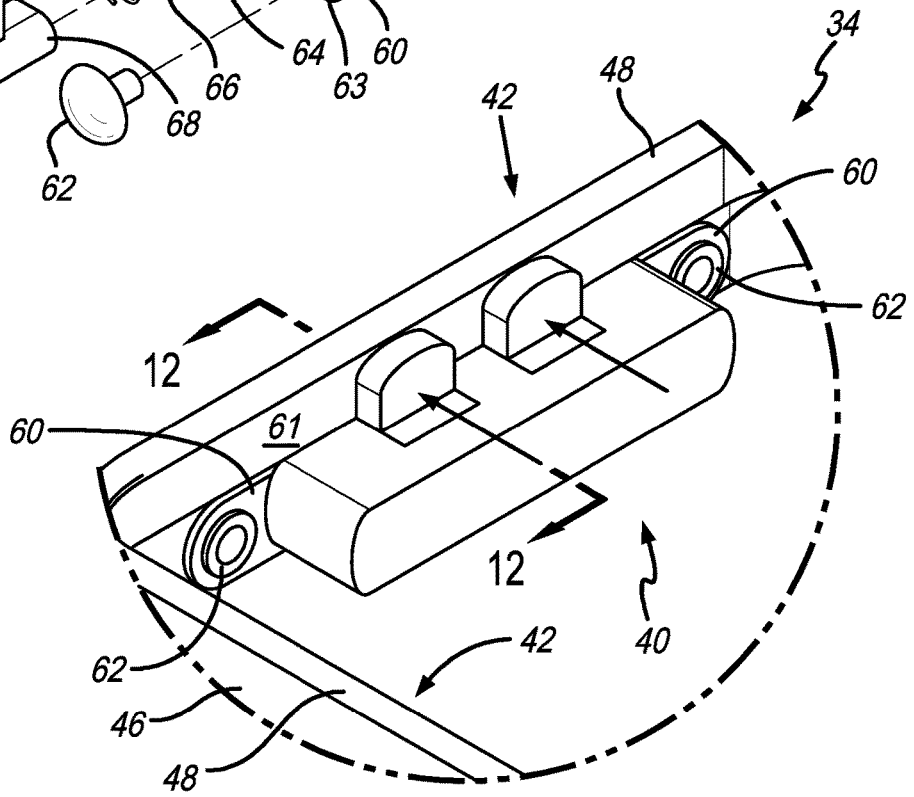
FIG. 11 is an enlarged perspective view taken about the circle 11 in FIG. 9, more specifically illustrating the locking system mounted to a sidewall of the storage container.
Figure 12:
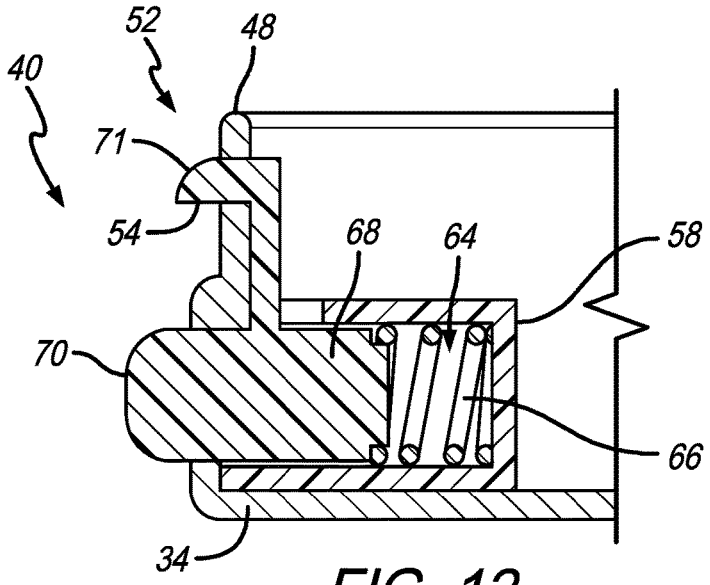
FIG. 12 is a cross-sectional view of the locking system taken about the line 12-12 in FIG. 11, further illustrating a spring-biased slide block within an interior channel of the housing.
Figure 13:
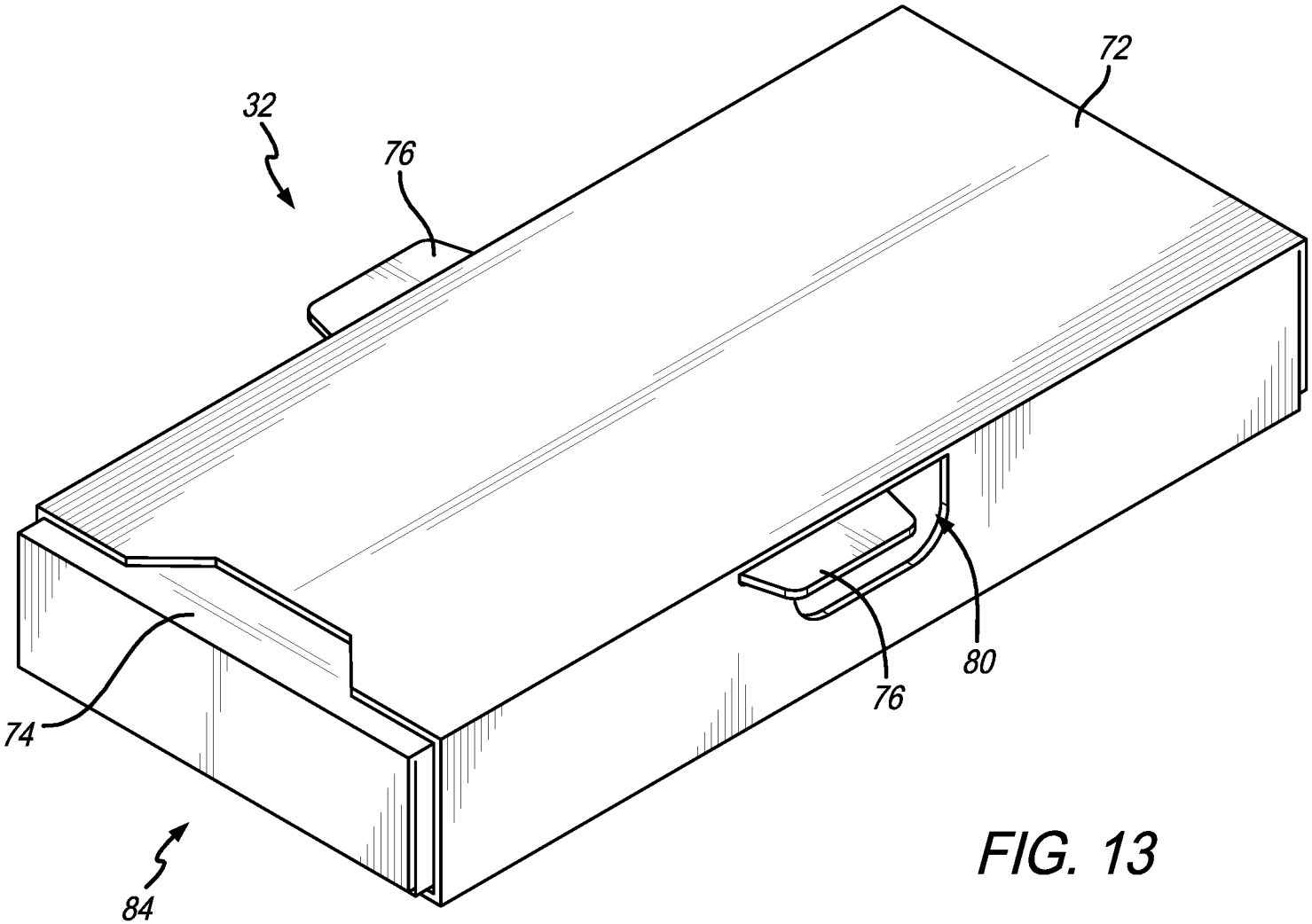
FIG. 13 is a perspective view illustrating a front, top and left sides of another embodiment of a child-resistant container as disclosed herein, in the form of a child-resistant box.
Figure 14:
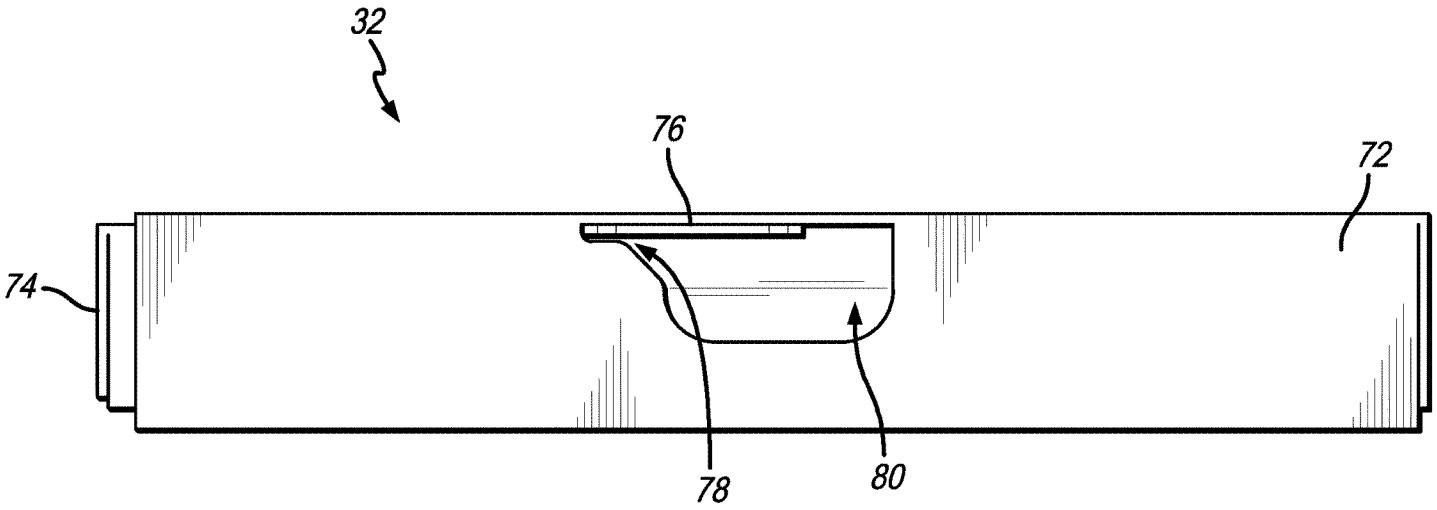
FIG. 14 is a front elevation view of the child-resistant box of FIG. 13, further illustrating one of a pair of safety tabs residing within one of a pair of respective locking channels.
Figure 15:
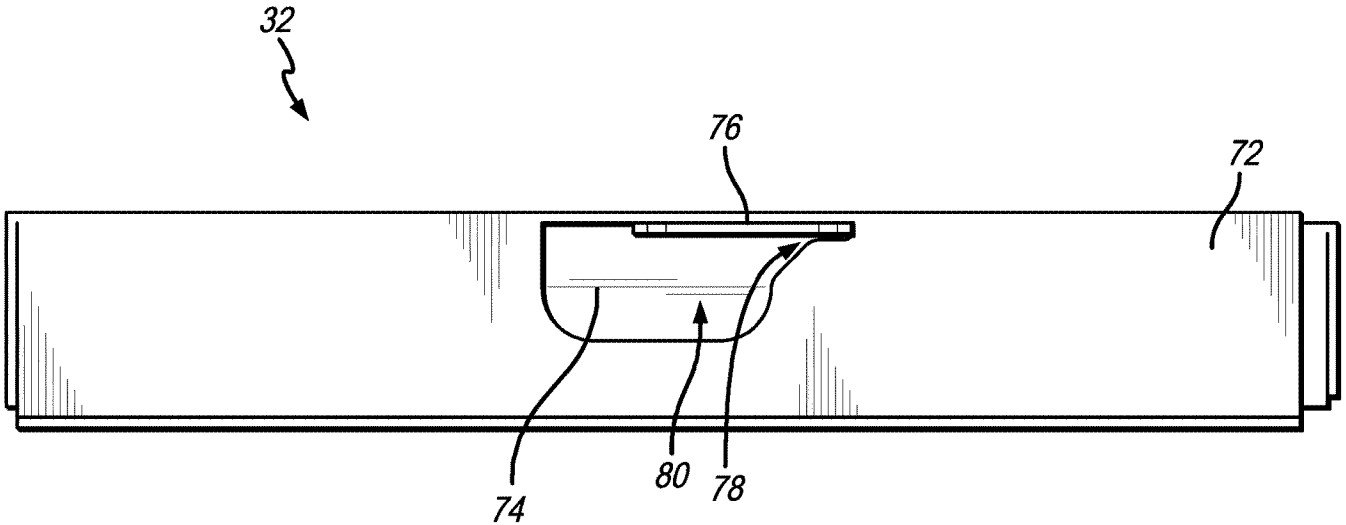
FIG. 15 is a rear elevation view of the child-resistant box of FIGS. 13-14, further illustrating the other of the pair of safety tabs residing within the other of the pair of respective locking channels.
Figure 16:
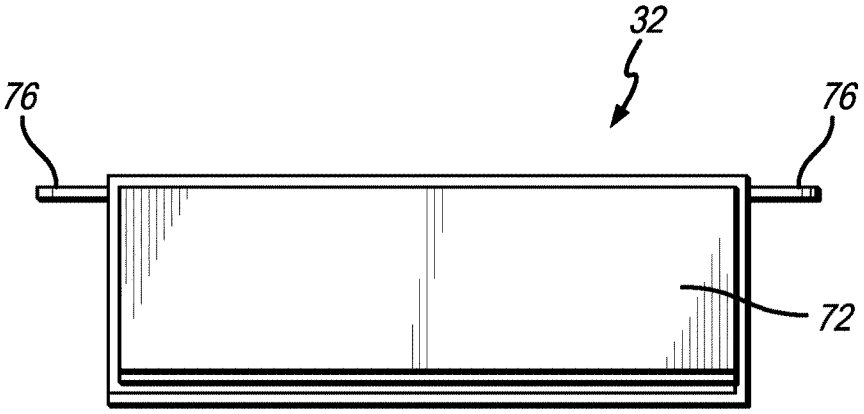
FIG. 16 is a right side elevation view of the child-resistant box of FIGS. 13-15, further illustrating each of the pair of safety tabs extending from opposite sides of an outer housing of the child-resistant box.
Figure 17:
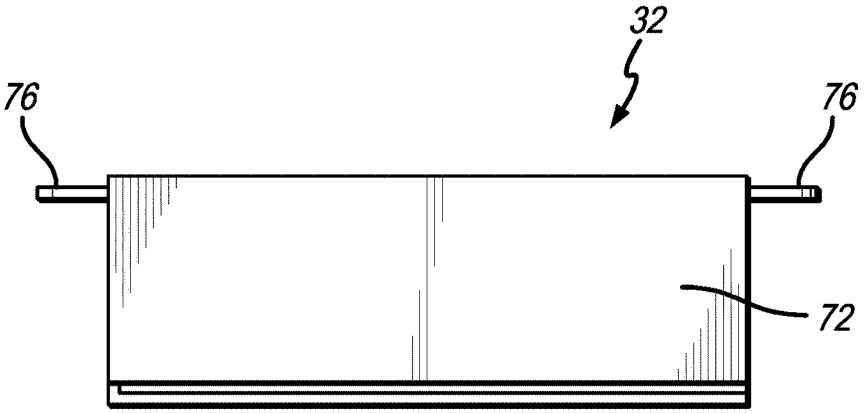
FIG. 17 is a left side elevation view of the child-resistant box of FIGS. 13-16.
Figure 18:
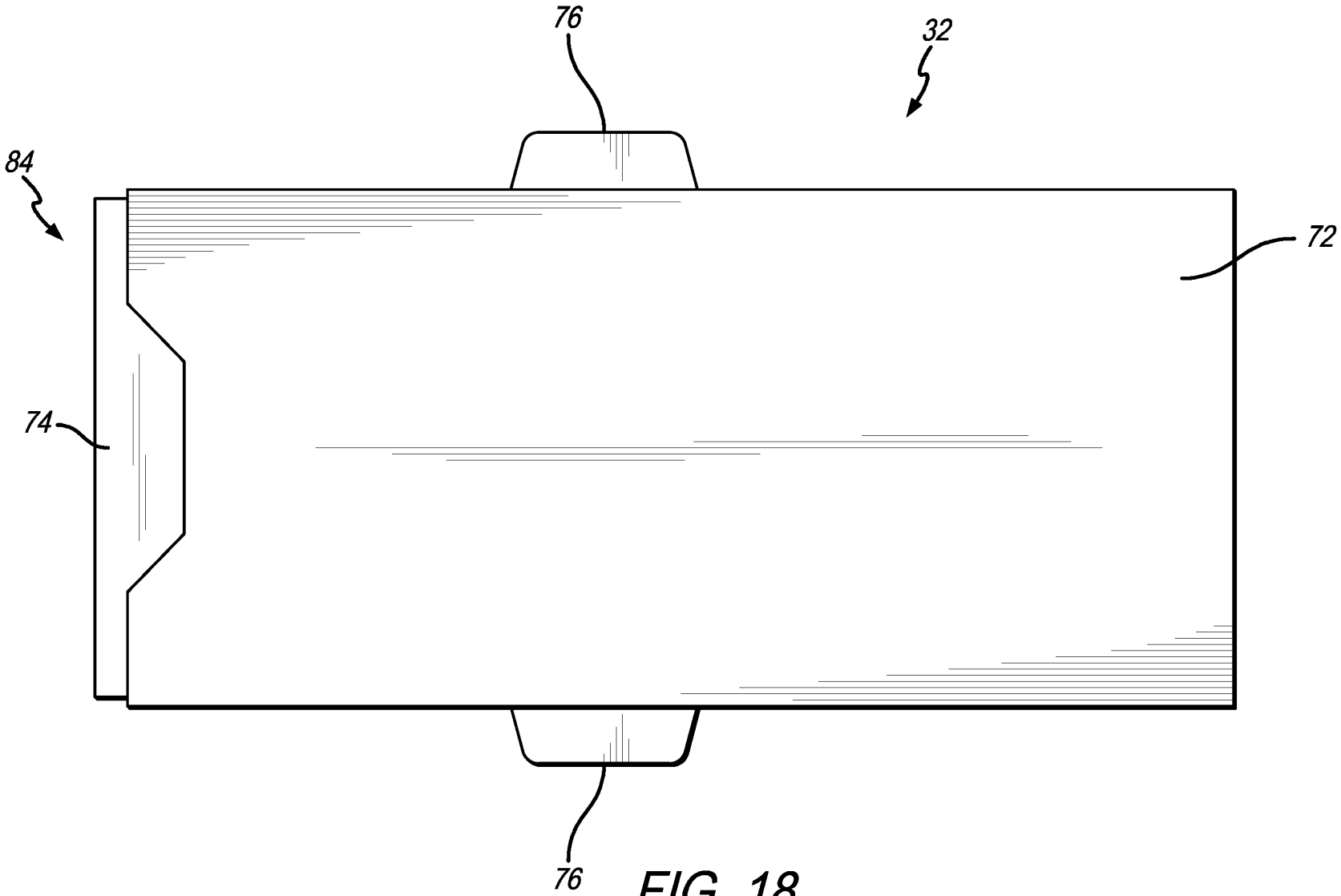
FIG. 18 is a top plan view of the child-resistant box of FIGS. 13-17.
Figure 19:
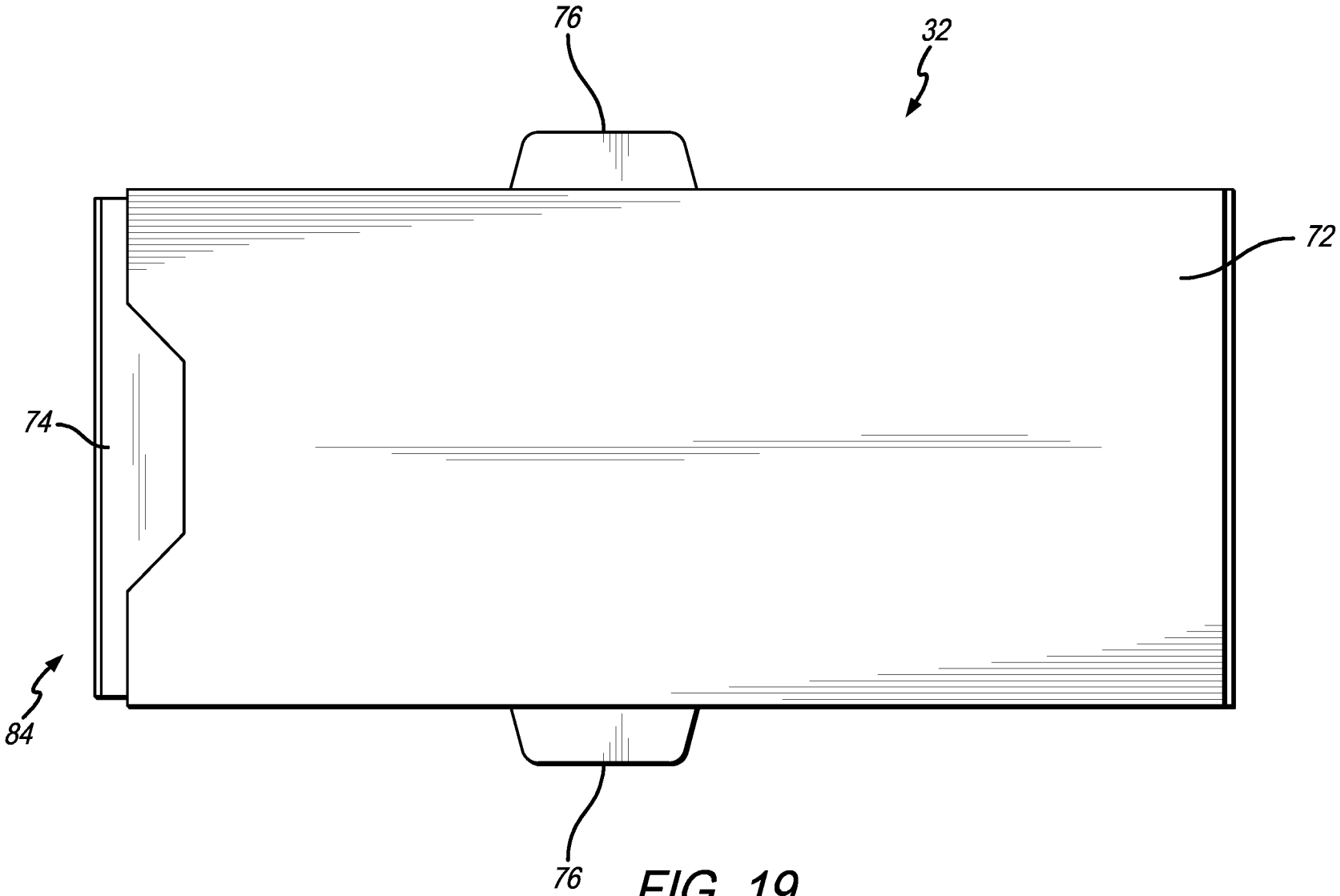
FIG. 19 is a bottom plan view of the child-resistant box of FIGS. 13-18.

As shown best in FIGS. 10-12, the locking system 40 may include a housing 58 forming a general boxlike structure with a pair of mounting wings 60 outwardly projecting from each side and configured for flush engagement with an inner surface 61 of one of the side walls 42 of the storage container 34 (e.g., as illustrated in FIG. 11). A pair of mounting bolts 62 may be configured to extend through a respective pair of apertures 63 (FIG. 10) formed in each of the mounting wings 60 for attachment of the locking system 40 to one of the sidewalls 42 of the storage container 34. In this respect, the exploded perspective view of FIG. 10 and the cross-sectional view of FIG. 12 illustrate that the housing 58 of the locking system 40 includes a pair of interior channels 64 housing a pair of springs 66 that abut a pair of rear slide blocks 68 generally integrally formed with the outwardly extending locking catches 52 and a respective pair of release buttons 70. While the locking system 40 as disclosed herein illustrates a pair of the locking catches 52, a pair of the downwardly facing planar shoulders 54, a pair of the interior channels 64, a pair of the springs 66, a pair of the slide blocks 68, and a pair of the release buttons 70, the locking system 40 may include as few as one of each of these components, or more than the pair of each of these components.

In operation, when the child-resistant tin 30 is in the closed position illustrated in FIGS. 1-6, applying a force along each of the directional Arrows A in FIG. 1 facilitates compression of each of the release buttons 70 (and the internally located slide block 68) against the spring 66 within the interior channel 64. Normally, the spring 66 biases the release buttons 70 (and the outwardly extending locking catches 52) in a forward position such that the downwardly facing planar shoulders 54 also extend out from within one of the sidewalls 42 for engagement with the inwardly curved lip 56 of the annular skirt 50. As such, depressing both of the release buttons 70 against respective springs 66 simultaneously causes each of the locking catches 52 to commensurately move inwardly with the release buttons 70 toward the interior of the storage container 34. In one embodiment, each of the release buttons 70 may move independently of one another. That is, depression of one release button 70 may only cause disengagement of one of the locking catches 52. In this embodiment, it would be necessary to depress the second release button 70 simultaneously, to unlock the lid 36 from the storage container 34. Alternatively, the release buttons 70 may be interconnected such that depression of one of the release buttons 70 effectively operates both, wherein both of the locking catches 52 may disengage through movement of only one of the release buttons 52. Effectively, depressing the release buttons 70 causes the downwardly facing planar shoulders 54 of the locking catches 52 to retract out from a normal outwardly projecting position, e.g., as best shown in FIG. 12. When retracted, the downwardly facing planar shoulders 54 no longer provide a surface area sufficient for engagement with the inwardly curved lip 56 of the annular skirt 50 to remain coupled thereto. As a result, the lid 36 is no longer held in the closed position, and can be rotated about the hinge 38 to an open position as generally illustrated in FIGS. 7-9.

Of course, removal of the force along Arrows A in FIG. 1 allows the spring 66 to push the release buttons 70 and the locking catches 52 back out beyond the respective side wall 42. Here, closing and locking the child-resistant tin 30 may be accomplished by rotating the lid 36 about the hinge 38 such that the annular skirt 50 is moved to an adjacent and seated position on the step 46 wherein the annular skirt 50 extends down over the locking catches 52 for engagement therewith by way of the inwardly curved lip 56. Here, the downwardly facing planar shoulders 54 provide sufficient surface area engagement to retain the annular skirt 50 of the lid 36 a closed and locked position. Each of the locking catches 52 may include a rounded or curved/arcuate upper surface 71 to better facilitate sliding movement of the annular skirt 50 over the locking latches 52 and for snap-fit engagement up underneath against the downwardly facing planar shoulders 54. When back in the closed position, the lid 36 remains attached to the storage container 34 until the release buttons 70 are again depressed and retracted within the housing 58 by a distance sufficient to withdraw the downwardly facing planar shoulders 54 out from engagement with the annular skirt 50. Once disengaged, the contents stored within the interior of the storage container 34 can then be accessed again by rotating the lid 36 relative to the storage container 34 about the hinge 38.

In another embodiment as disclosed herein with respect to FIGS. 13-28, the child-resistant box 32 may generally include an outer housing 72 having a size and shape to selectively receive and retain an inner storage container 74 therein. When in a normally closed position, e.g., as illustrated in FIGS. 13-19, a pair of safety tabs 76 extend out beyond opposing sides of the outer housing 72 and reside forwardly biased within a locking channel 78 designed as a forward slot to prevent pull out removal of the inner storage container 74 out from within the outer housing 72 when in this normal closed position. Although, the locking channel 78 is in slideable relation with a rearly positioned and relatively larger release channel 80 having a size and shape relatively larger than one of the pair of safety tabs 76. The size and shape of the release channels 80 permit inward folding of each of the safety tabs 76 into the interior of the outer housing 72 for purposes of disengaging the inner storage container 74 from the outer housing 72, to permit removal therefrom as discussed in more detail herein.

Normally, the inner storage container 74 is biased in a forward position as generally illustrated in FIGS. 13-19 with each of the safety tabs 76 firmly located within respective locking channels 78. This ensures that the inner storage container 74 remains locked to the outer housing 72 to prohibit access to contents therein (e.g., medicinal products such as gummies or candies containing CBD) during non-use. The storage container 74 may be generally biased into this forward position by an internally located spring 82, such as the foam insert 82 illustrated in the partial cut-away perspective views of FIGS. 27 and 28. As shown best in FIGS. 13-14 and 18-19, a front end 84 of the inner storage container 74 may extend out from a portion of the outer housing 72 for purposes of hand manipulation to open the inner storage container 74 to access product inside.

Figure 20:
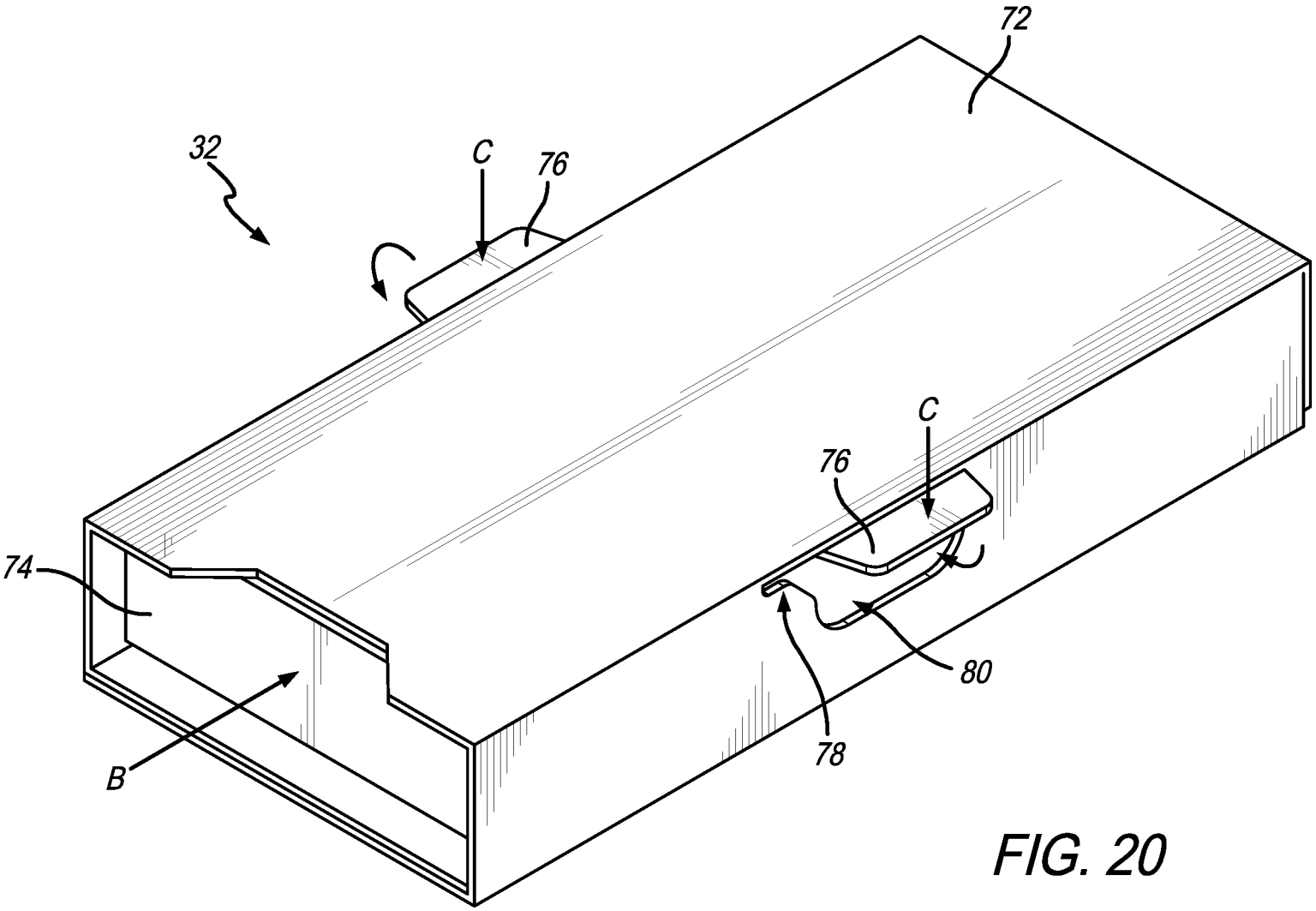
FIG. 20 is a perspective view of the child-resistant box similar to FIG. 13, further illustrating inward movement of an alternative inner storage container and inward rotation of the pair of safety tabs within a now aligned corresponding pair of release channels in the outer housing.
Figure 21:
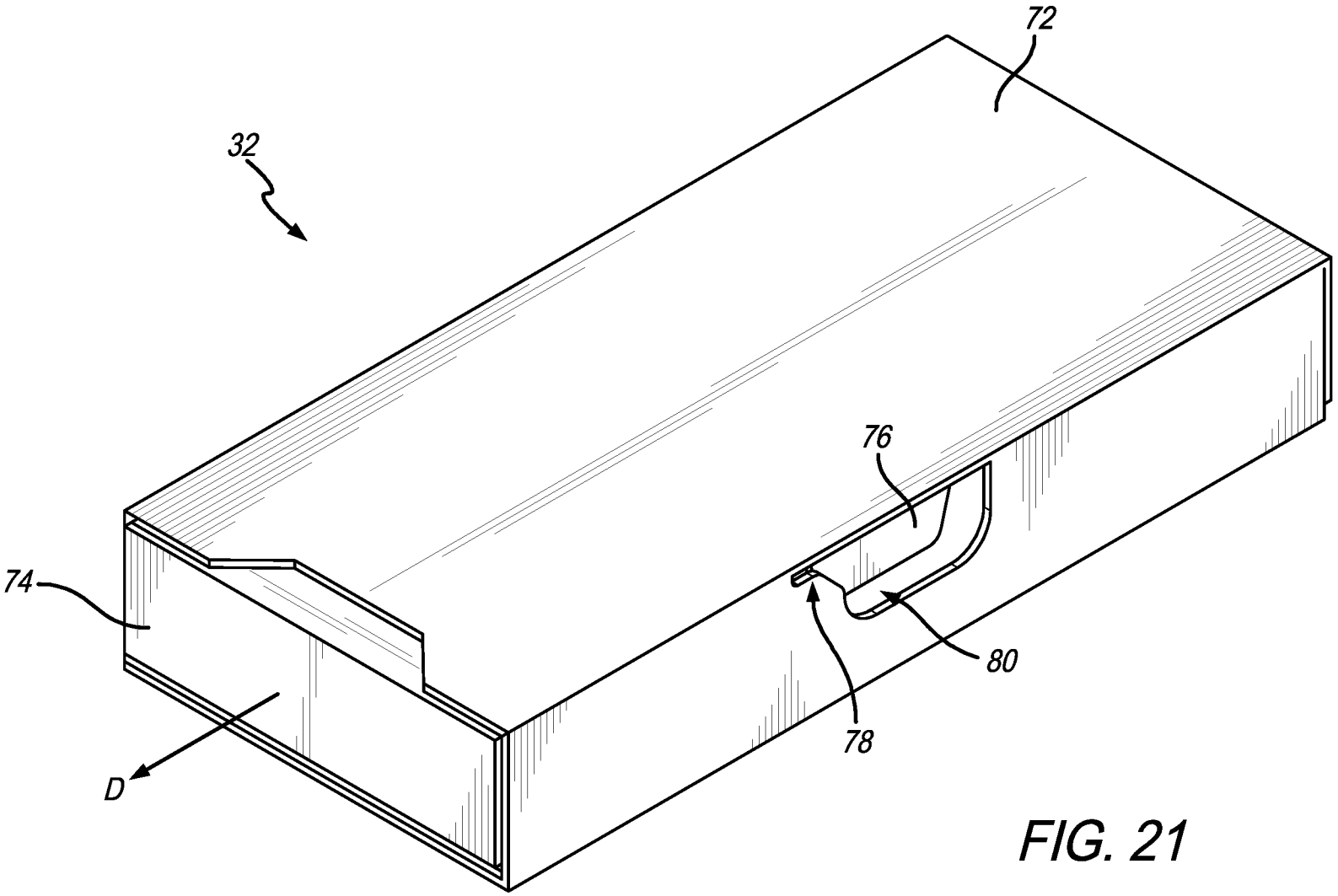
FIG. 21 is a perspective view similar to FIG. 20, further illustrating outward movement of the inner storage container with the pair of safety tabs positioned within the outer housing.
Figure 22:
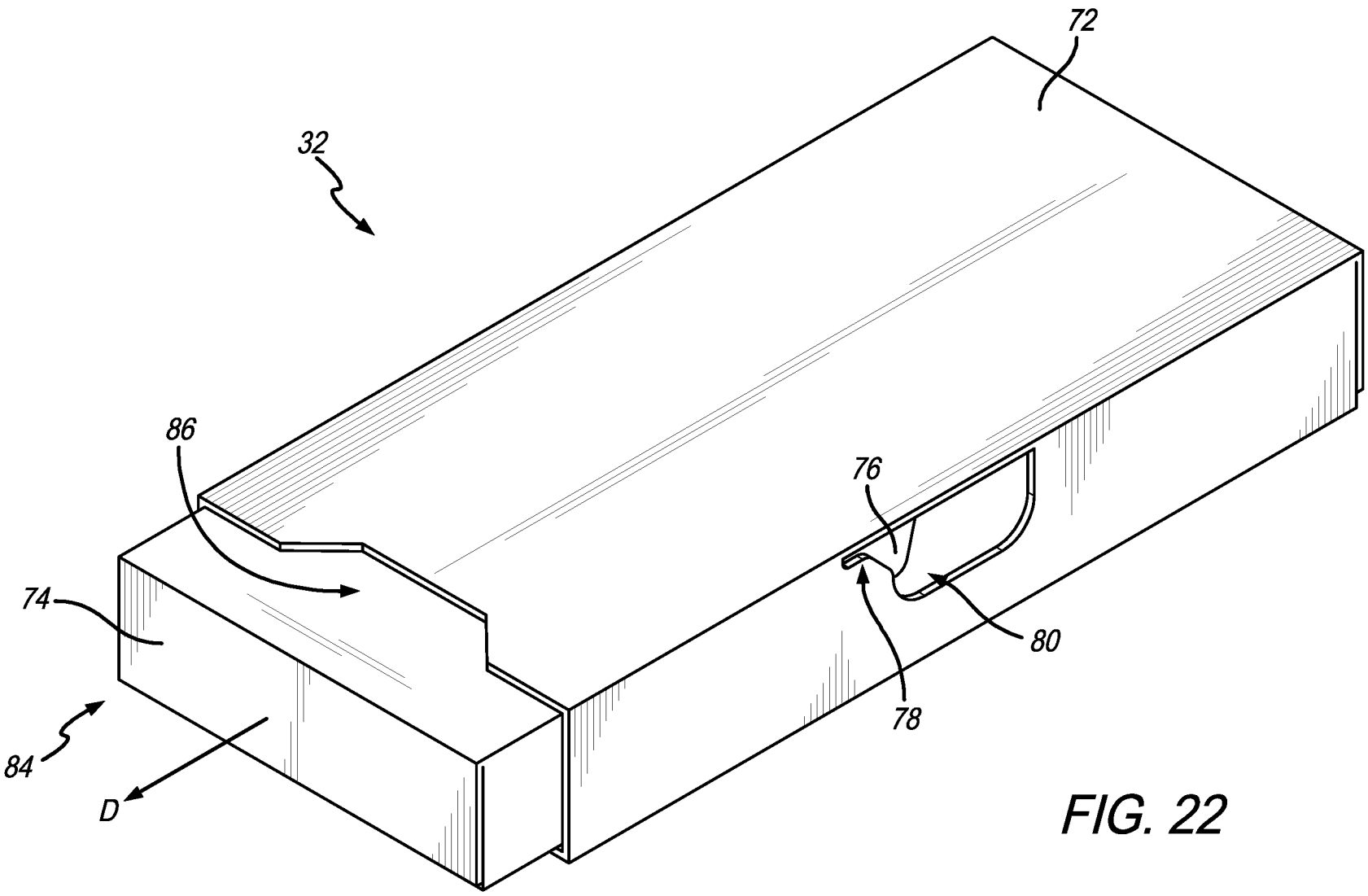
FIG. 22 is a perspective view similar to FIG. 21, further illustrating slide out removal of the inner storage container out from within the outer housing.
Figure 23:
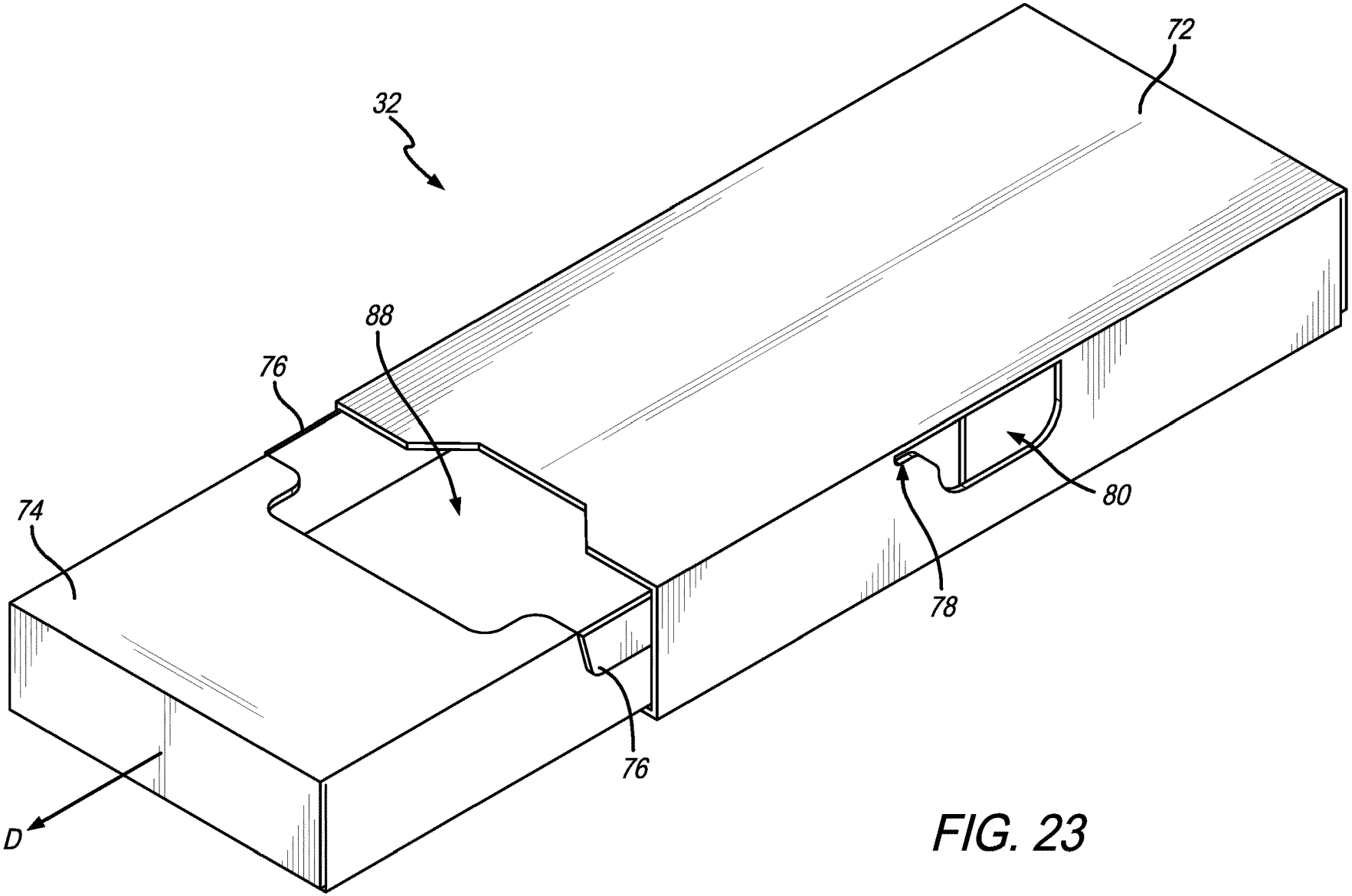
FIG. 23 is a perspective view similar to FIGS. 21 and 22, further illustrating removal of the inner storage container from the outer housing.
Figure 24:
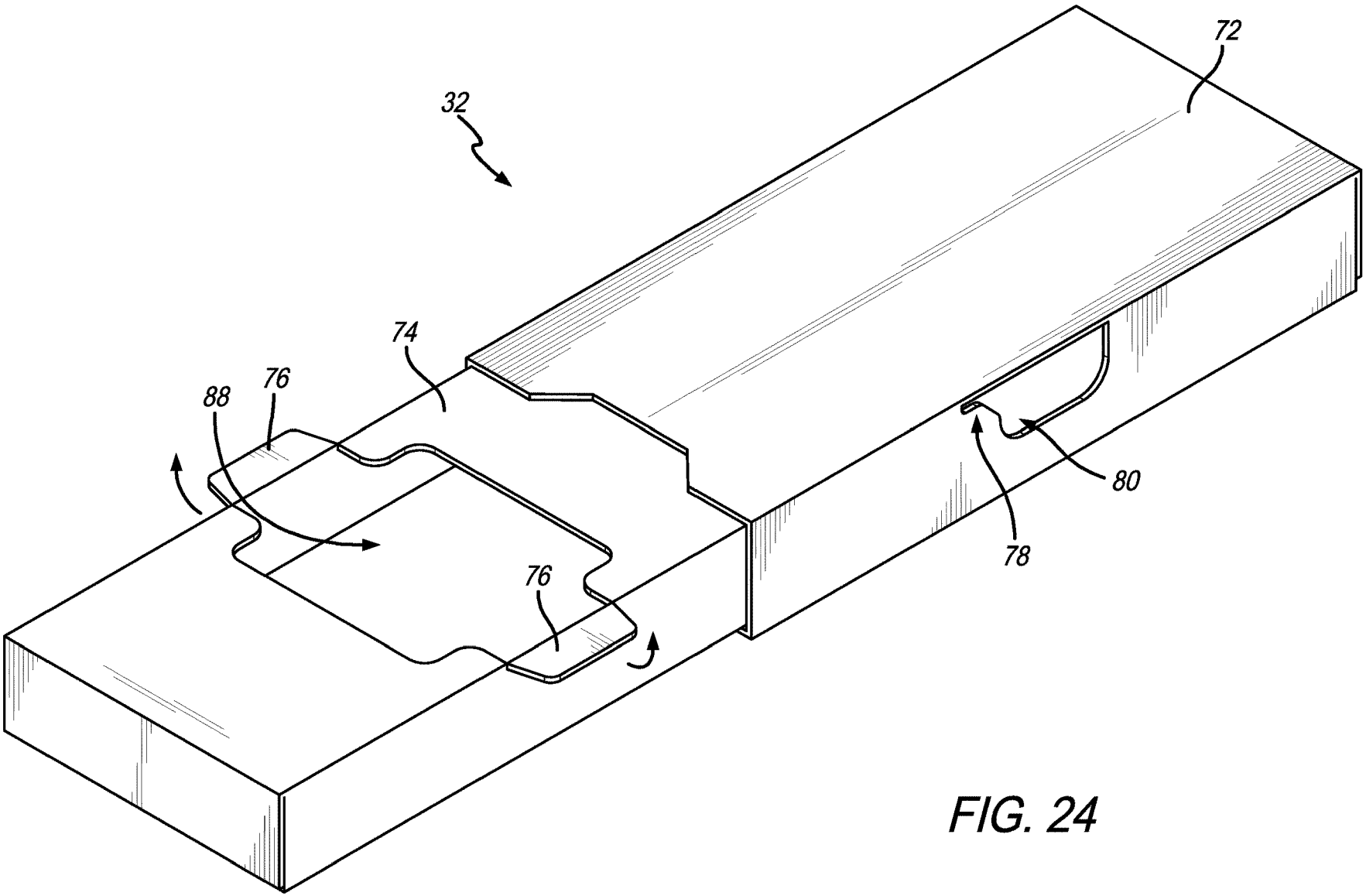
FIG. 24 is a perspective view similar to FIGS. 21-23, further illustrating outward rotation of each of the safety tabs to a normal vertical configuration with substantial removal of the inner storage container from the outer housing.

In operation, FIG. 20 illustrates applying a force along Arrow B to depress the storage container 74 within the outer housing 72 against the spring 82 located therein. Such movement of the storage container 74 within the outer housing 72 causes each of the safety tabs 76 to move out of engagement with each of the locking channels 78 and into general alignment with each of the release channels 80. Here, as also illustrated in FIG. 20, the safety tabs 76 may fold or bend inwardly toward the body of the inner storage container 74 and through the opening formed by the relatively larger release channels 80. At this point, releasing application of the force applied along Arrow B (FIG. 20) allows the internally located spring 82 to push the inner storage container 72 out from within the outer housing 72 along Arrow D (FIG. 21) to the eventual resting position illustrated in FIG. 22. Here, as shown in FIG. 22, the inwardly folded safety tabs 76 remain folded flush against the inner storage container 74 and within the outer housing 72, and are otherwise no longer extending out from either of the locking channels 78 or the release channels 80. As shown in FIG. 22, a portion of the front end 84 of the storage container 74 extends out from within the interior of the outer housing 72 to permit better hand manipulation thereof for purposes grasping and removing the inner storage container 74 out from within the outer housing 72. In this respect, the outer housing 72 may include a notch 86 that exposes a greater surface area of the inner storage container 74, as generally illustrated in FIG. 22, to help facilitate hand grasping removal therefrom.

The fact that each of the safety tabs 76 have been folded flush with the inner storage container 74 through the release channels 80 and to a position within the interior of the outer housing 72 prevents the safety tabs 76 from reengaging the locking channels 78 upon slide-out removal of the inner storage container 74. As such, as illustrated in progression from FIG. 22 to FIG. 24, the safety tabs 76 are now free to move or slide within the outer housing 72 so the storage container 74 may be pulled out from within the outer housing 72 for purposes of exposing an inner storage cavity 88 therein. The inner storage cavity 88 may be designed to store medicinal products, such as gummies, candies, or other edibles or consumables.

Figure 25:
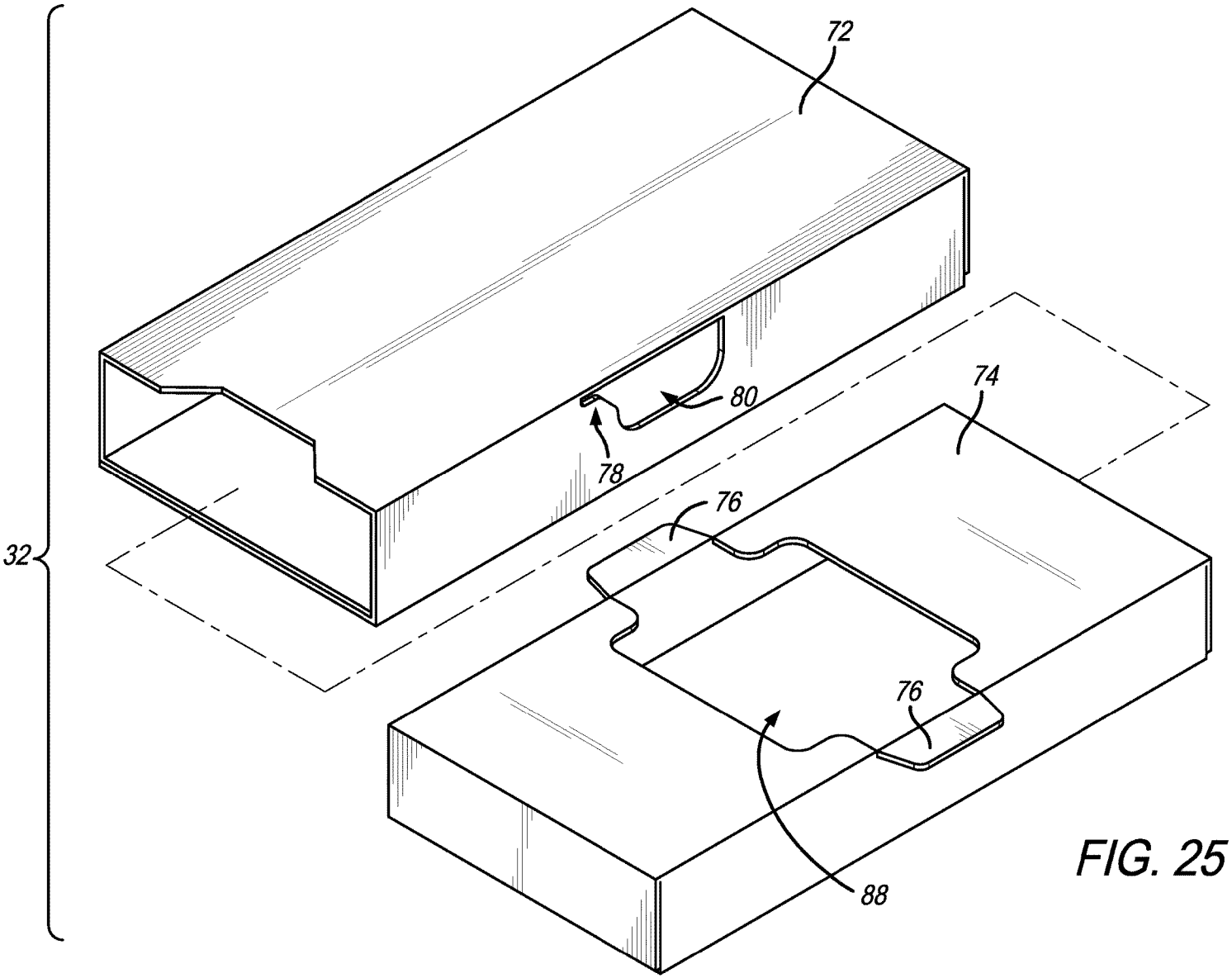
FIG. 25 is an exploded perspective view illustrating the inner storage container completely removed from the outer housing.
Figure 26:
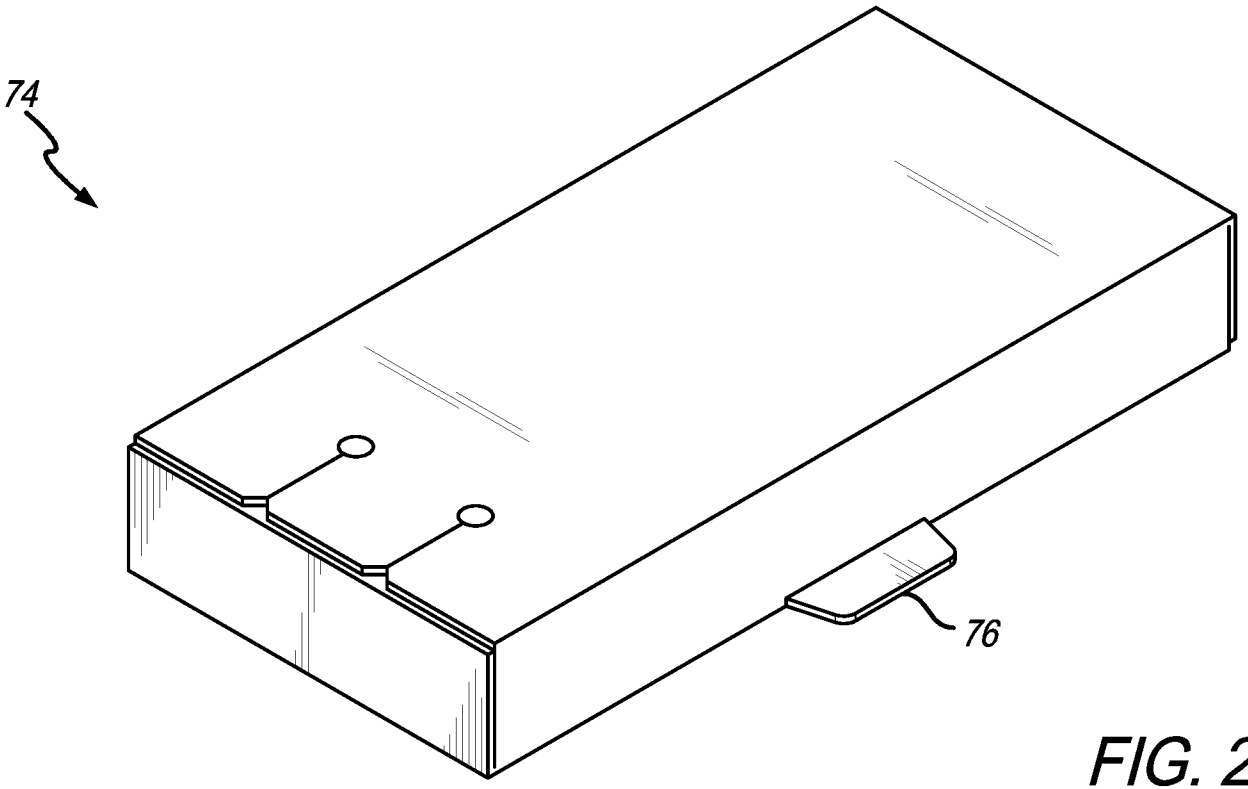
FIG. 26 is a bottom perspective view of the removed inner storage container.
Figure 27:
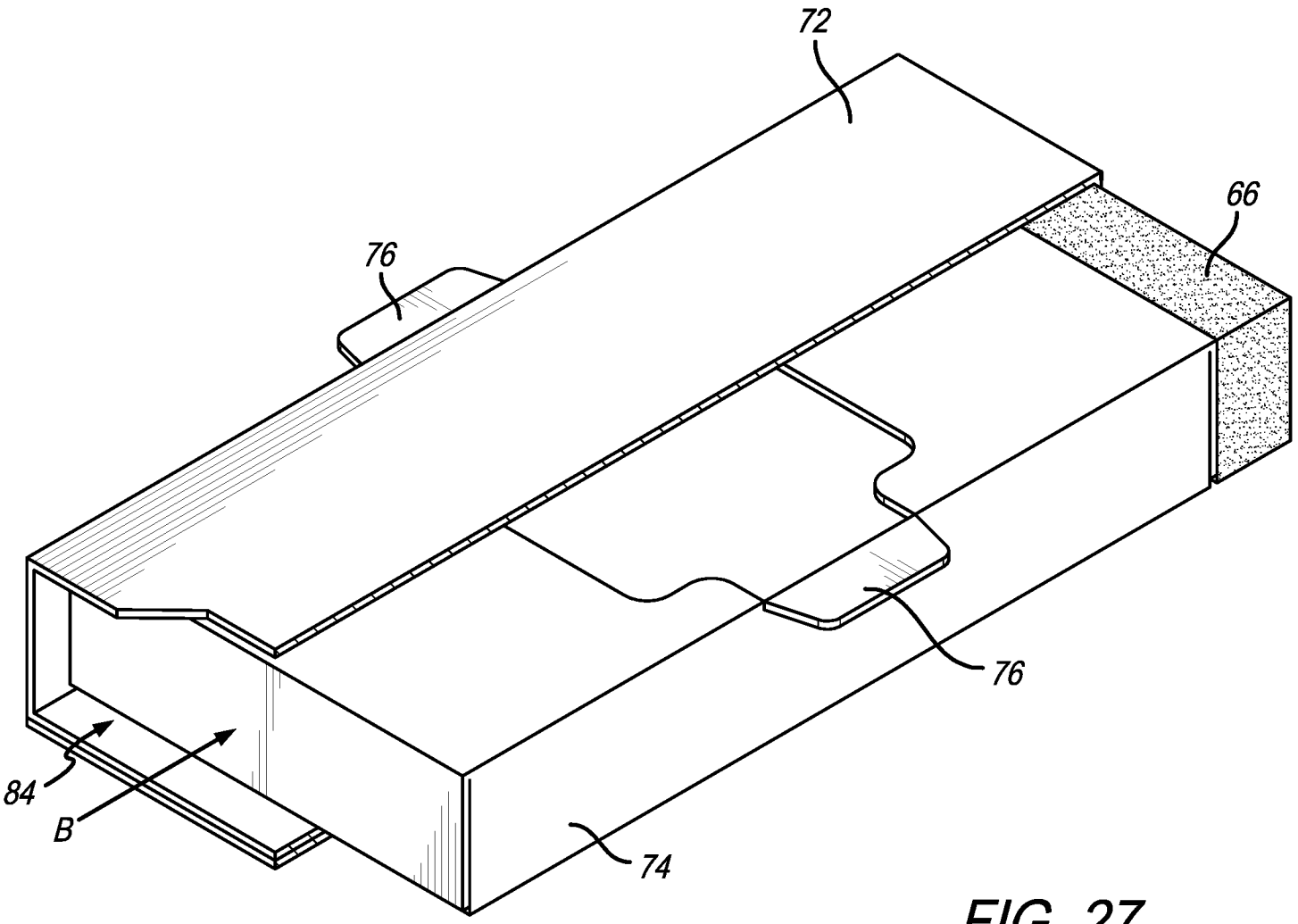
FIG. 27 is a partial cut-away perspective view illustrating an internally located sponge in a compressed position.
Figure 28:
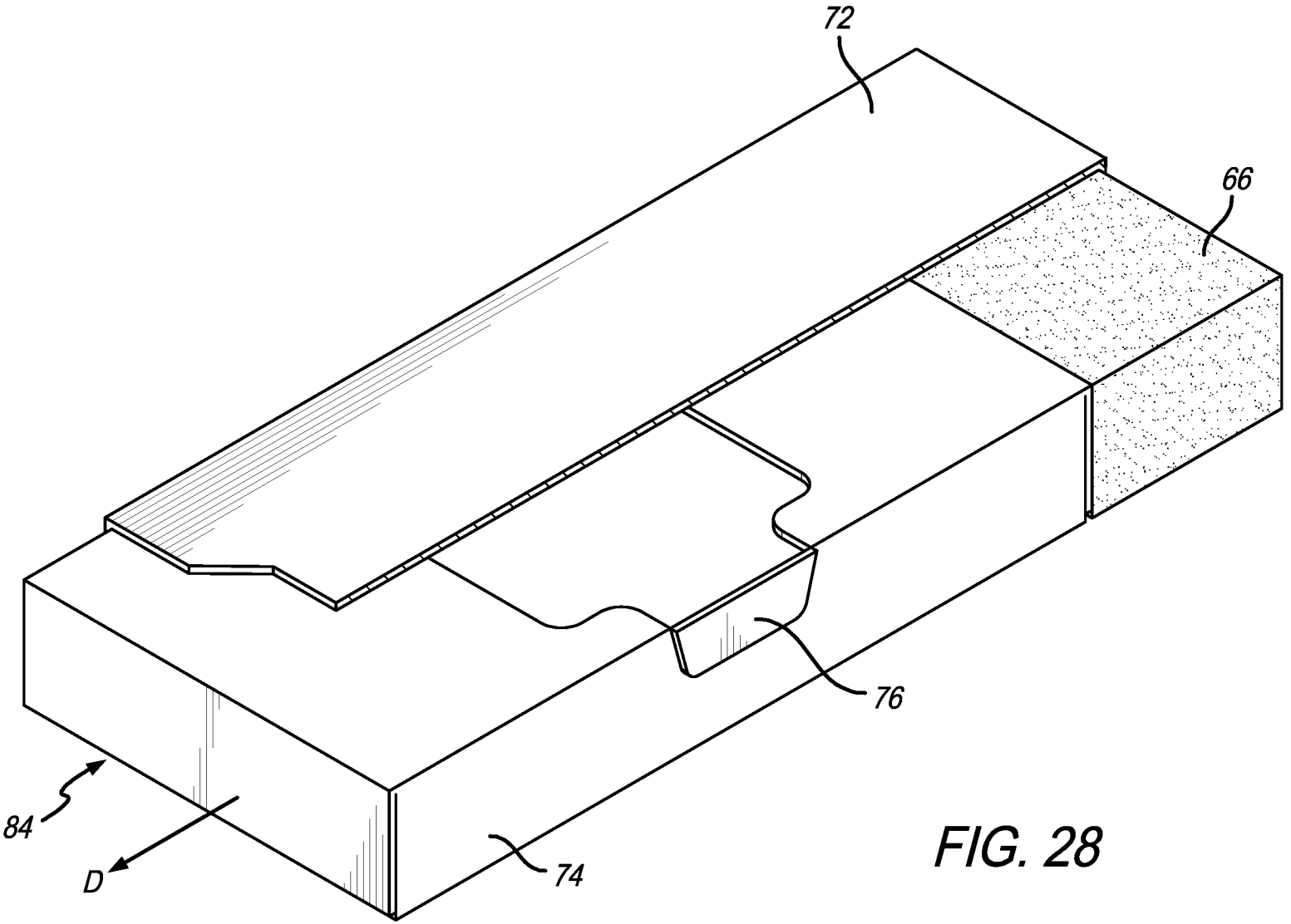
FIG. 28 is a partial cut-away perspective view illustrating the internally located sponge in a normal uncompressed position.

In this respect, FIG. 25 illustrates the inner storage container 74 completely removed out from within the interior of the outer housing 72 and in exploded relation relative thereto. Once removed, each of the safety tabs 76 may spring outwardly back into a normal generally perpendicular position as illustrated in FIGS. 25 and 26.

The storage container 74 may be reinserted within the interior of the outer housing 72 by folding each of the safety tabs 76 flush with an outer surface thereof to fit within the inner side walls of the outer housing 74. Here, sliding the storage container 74 back into the outer housing 72 allows the safety tabs 76 to travel flush therein until realigned with the release channel 80. Accordingly, when the safety tabs 76 realign with the respective release channels 80, each of the safety tabs 76 spring bias outwardly, thereby extending out from within the interior of the outer housing 74 and into the position illustrated, e.g., in FIG. 20. Releasing the storage container 74 from depressing the spring 82 causes the spring 82 to push the inner storage container 74 back to a normal engaged position wherein each of the safety tabs 76 reside within each of the now aligned respective locking channels 78. Consequently, though the front end 84 of the inner storage container 74 projects out from within the outer housing 72, engagement of the safety tabs 76 within each of the locking channels 78 prevents removal therefrom. In effect, the inner storage cavity 88 is locked and no longer easily accessible by, e.g., a child.

Although several embodiments have been described in detail for purposes of illustration, various modifications may be made without departing from the scope and spirit of the invention. Accordingly, the invention is not to be limited, except as by the appended claims.

What is claimed is:

1. A child-resistant container, comprising:

a receptacle having an inner cavity;

a lid that selectively couples with the receptacle to enclose the inner cavity when in a locked position;

a lock disposed within the inner cavity movable between the locked position securing the lid to the receptacle to substantially prevent access to the inner cavity and an unlocked position permitting the lid to move relative to the receptacle to expose access to the inner cavity; and a food-grade protective sheath disposed over an inner surface of the inner cavity having a size and shape accommodating the lock thereunder.

2. The child-resistant container of claim 1, wherein the receptacle pivots relative to the lid about a hinge.

3. The child-resistant container of claim 1, wherein the child-resistant container comprises a metal material selected from the group consisting of steel, aluminum, or a metal alloy.

4. The child-resistant container of claim 1, wherein at least one sidewall of the receptacle includes an annular shoulder vertically extending upwardly from a base and transitioning at an inwardly projecting step to an interiorly located upper rim having a wall thickness relatively smaller than the annular shoulder.

5. The child-resistant container of claim 4, wherein the lid includes a downwardly extending annular skirt that selectively lands in seated relation on the inwardly projecting step and is positioned adjacent the upper rim when the child-resistant container is in the locked position.

6. The child-resistant container of claim 5, wherein the downwardly extending annular skirt encompasses the upper rim when in seated relation on the inwardly projecting step.

7. The child-resistant container of claim 5, wherein the lock includes at least one locking catch outwardly extending from the receptacle and having a downwardly facing planar shoulder that engages an inwardly curved lip of the annular skirt when the lid is in the locked position.

8. The child-resistant container of claim 7, wherein the lock includes at least one channel having a spring therein that normally biases the locking catch and an integrally formed release button in a forward position externally accessible from the receptacle.

9. The child-resistant container of claim 7, wherein the at least one locking catch includes a rounded upper surface opposite the downwardly facing planar shoulder.

10. A child-resistant container, comprising:

a receptacle having an inner cavity;

a lid that selectively couples with the receptacle to enclose the inner cavity and substantially prevent access to the inner cavity when in a locked position;

a lock disposed within the inner cavity including a spring that normally biases a catch and an integrally formed release button into a forward position outwardly extending from the receptacle, the catch including a shoulder normally hidden when engaged with the lid when in the locked position, the release button being inwardly depressible against the spring to simultaneously move the catch out from engagement with the lid to an unlocked position permitting the lid to move relative to the receptacle to expose access to the inner cavity; and a food-grade protective sheath disposed over an inner surface of the inner cavity and having an indent of a size and shape to accommodate the lock thereunder.

11. The child-resistant container of claim 10, wherein the receptacle pivots relative to the lid about a hinge and the child-resistant container comprises a metal material selected from the group consisting of steel, aluminum, or a metal alloy.

12. The child-resistant container of claim 10, wherein at least one sidewall of the receptacle includes an annular shoulder vertically extending upwardly from a base and transitioning at an inwardly projecting step to an interiorly located upper rim having a wall thickness relatively smaller than the annular shoulder, the inwardly projecting step receiving a downwardly extending annular skirt of the lid in seated reception when the child-resistant container is in the locked position.

13. The child-resistant container of claim 12, wherein the downwardly extending annular skirt encompasses the upper rim when in seated reception on the inwardly projecting step and the catch includes a rounded upper surface opposite a downwardly facing planar shoulder.

14. A child-resistant container, comprising:

a receptacle having an inner cavity, wherein at least one sidewall of the receptacle includes an annular shoulder vertically extending upwardly from a base and transitioning at an inwardly projecting step to an interiorly located upper rim having a wall thickness relatively smaller than the annular shoulder;

a lid that selectively couples with the receptacle to enclose the inner cavity when in a locked position; and a lock movable between the locked position securing the lid to the receptacle to substantially prevent access to the inner cavity and an unlocked position permitting the lid to move relative to the receptacle to expose access to the inner cavity.

15. The child-resistant container of claim 14, wherein the receptacle pivots relative to the lid about a hinge.

16. The child-resistant container of claim 14, wherein the child-resistant container comprises a metal material selected from the group consisting of steel, aluminum, or a metal alloy.

17. The child-resistant container of claim 14, including a food-grade protective sheath disposed over an inner surface of the inner cavity.

18. The child-resistant container of claim 14, wherein the lid includes a downwardly extending annular skirt that selectively lands in seated relation on the inwardly projecting step and is positioned adjacent the upper rim when the child-resistant container is in the locked position.

19. The child-resistant container of claim 18, wherein the downwardly extending annular skirt encompasses the upper rim when in seated relation on the inwardly projecting step.

20. The child-resistant container of claim 18, wherein the lock includes at least one locking catch outwardly extending from the receptacle and having a downwardly facing planar shoulder that engages an inwardly curved lip of the annular skirt when the lid is in the locked position.

21. The child-resistant container of claim 20, wherein the lock includes at least one channel having a spring therein that normally biases the locking catch and an integrally formed release button in a forward position externally accessible from the receptacle.

22. The child-resistant container of claim 20, wherein the at least one locking catch includes a rounded upper surface opposite the downwardly facing planar shoulder.

23. A child-resistant container, comprising:

a receptacle having an inner cavity;

a lid that selectively couples with the receptacle to enclose the inner cavity and substantially prevent access to the inner cavity when in a locked position; and a lock including a spring that normally biases a catch and an integrally formed release button into a forward position outwardly extending from the receptacle, the catch including a shoulder normally hidden when engaged with the lid when in the locked position, the release button being inwardly depressible against the spring to simultaneously move the catch out from engagement with the lid to an unlocked position permitting the lid to move relative to the receptacle to expose access to the inner cavity;

wherein at least one sidewall of the receptacle includes an annular shoulder vertically extending upwardly from a base and transitioning at an inwardly projecting step to an interiorly located upper rim having a wall thickness relatively smaller than the annular shoulder, the inwardly projecting step receiving a downwardly extending annular skirt of the lid in seated reception when the child-resistant container is in the locked position.

24. The child-resistant container of claim 23, wherein the receptacle pivots relative to the lid about a hinge and the child-resistant container comprises a metal material selected from the group consisting of steel, aluminum, or a metal alloy.

25. The child-resistant container of claim 23, wherein the downwardly extending annular skirt encompasses the upper rim when in seated reception on the inwardly projecting step and the catch includes a rounded upper surface opposite a downwardly facing planar shoulder.

* * * * *